US010846988B2

(12) United States Patent
Berman et al.

(10) Patent No.: US 10,846,988 B2
(45) Date of Patent: Nov. 24, 2020

(54) APPARATUS AND METHOD FOR DETERMINING GAMING PAYOUTS USING PARTIAL GAME CRITERIA

(76) Inventors: Bradley Berman, Minnetonka, MN (US); Jacob Lamb, Maple Grove, MN (US)

( * ) Notice: Subject to any disclaimer, the term of this patent is extended or adjusted under 35 U.S.C. 154(b) by 1497 days.

(21) Appl. No.: 11/301,242

(22) Filed: Dec. 12, 2005

(65) Prior Publication Data

US 2006/0128456 A1 Jun. 15, 2006

Related U.S. Application Data

(60) Provisional application No. 60/634,877, filed on Dec. 10, 2004.

(51) Int. Cl.
*G07F 17/32* (2006.01)

(52) U.S. Cl.
CPC ..... *G07F 17/3244* (2013.01)

(58) Field of Classification Search
CPC ..... G07F 17/3244; A63F 3/00157; A63F 17/3293
USPC ..... 463/1, 13, 16–18, 20–22, 25–28
See application file for complete search history.

(56) References Cited

U.S. PATENT DOCUMENTS 5,265,882 A 11/1993 Malek
5,328,189 A 7/1994 Malek
5,356,140 A 10/1994 Dabrowski et al.
5,377,993 A 1/1995 Josephs
5,382,025 A 1/1995 Sklansky et al.
5,486,005 A 1/1996 Neal
5,489,101 A 2/1996 Moody
5,496,038 A 3/1996 Kangsanaraks
5,531,441 A * 7/1996 Dabrowski et al. ..... 463/13
5,531,448 A 7/1996 Moody
5,573,249 A 11/1996 Johnson
5,577,731 A 11/1996 Jones
5,639,092 A 6/1997 Macaisa
5,657,993 A 8/1997 Merlino et al.
5,718,430 A 2/1998 Aramapakul et al.
5,732,950 A 3/1998 Moody
5,823,873 A 10/1998 Moody
5,845,907 A 12/1998 Wells
5,851,147 A * 12/1998 Stupak et al. ..... 463/13
5,951,012 A 9/1999 Feola
5,975,529 A 11/1999 De Keller
6,007,066 A 12/1999 Moody
6,098,985 A 8/2000 Moody
6,102,402 A 8/2000 Scott et al.
(Continued)

OTHER PUBLICATIONS

File History for U.S. Appl. No. 11/134,975.

*Primary Examiner* — David L Lewis
*Assistant Examiner* — Robert E Mosser

(57) ABSTRACT

Apparatuses and method for facilitating play in poker and slot gaming activities and providing manipulation of payout awards based on partial game criteria. A bonus value such as a multiplier is awarded based on a partial result of the gaming activity, if the partial result corresponds to any predetermined partial result(s). The gaming activity is completed to provide a complete result, and a payout is determined for the complete result. If the partial result corresponds to any of the predetermined partial results, the payout for the complete result is adjusted using the awarded bonus value to provide a final payout.

1 Claim, 17 Drawing Sheets

(56) References Cited

U.S. PATENT DOCUMENTS

| | | | | |
|---|---|---|---|---|
| 6,132,311 | A | 10/2000 | Williams | |
| 6,149,521 | A * | 11/2000 | Sanduski | 463/13 |
| 6,206,373 | B1 | 3/2001 | Garrod | |
| 6,435,500 | B2 | 8/2002 | Gumina | |
| 6,467,771 | B1 | 10/2002 | De Keller | |
| 6,474,645 | B2 | 11/2002 | Tarantino | |
| 6,481,717 | B1 | 11/2002 | Richardelle | |
| 6,511,068 | B1 * | 1/2003 | Sklansky et al. | 273/237 |
| 6,793,220 | B1 * | 9/2004 | Feola | 273/292 |
| 6,808,173 | B2 | 10/2004 | Snow | |
| 6,874,786 | B2 | 4/2005 | Bruno | |
| 6,893,342 | B1 * | 5/2005 | Singer et al. | 463/20 |
| 6,955,599 | B2 | 10/2005 | Bourbour et al. | |
| 2001/0052671 | A1 | 12/2001 | Stern | |
| 2001/0054796 | A1 | 12/2001 | Lo | |
| 2002/0008356 | A1 | 1/2002 | De Keller | |
| 2002/0025845 | A1 | 2/2002 | Cannon | |
| 2002/0043765 | A1 | 4/2002 | Moody | |
| 2002/0083560 | A1 | 7/2002 | Mennitto | |
| 2002/0103018 | A1 | 8/2002 | Rommerdahl et al. | |
| 2002/0142828 | A1 | 10/2002 | Moody | |
| 2004/0053680 | A1 | 3/2004 | Schultz | |
| 2005/0035548 | A1 | 2/2005 | Yoseloff | |
| 2006/0128454 | A1 | 6/2006 | Berman et al. | |

* cited by examiner

200

| 202 STARTING HAND TYPE | 204 MULTIPLIER |
|---|---|
| 2 RED ACES | 10 |
| SUITED ACE/KING | 5 |
| SUITED ACE/QUEEN | 4 |
| SUITED ACE/JACK | 3 |
| SUITED KING/QUEEN | 2 |
| SUITED KING/JACK | 2 |
| SUITED QUEEN/JACK | 2 |
| PAIR OF ACES | 7 |
| PAIR OF KINGS, QUEENS, OR JACKS | 4 |

*FIG. 2A*

210

| 202 STARTING HAND TYPE | 212 PAY |
|---|---|
| 2 RED ACES | 3 |
| SUITED ACE/KING | 1 |
| SUITED ACE/QUEEN | 1 |
| SUITED ACE/JACK | 1 |
| SUITED KING/QUEEN | 1 |
| SUITED KING/JACK | 1 |
| SUITED QUEEN/JACK | 1 |
| PAIR OF ACES | 2 |
| PAIR OF KINGS, QUEENS, OR JACKS | 1 |

*FIG. 2B*

220

| 202 STARTING HAND TYPE | 212 PAY | 204 MULTIPLIER |
|---|---|---|
| 2 RED ACES | 3 | 10 |
| SUITED ACE/KING | 1 | 5 |
| SUITED ACE/QUEEN | 1 | 4 |
| SUITED ACE/JACK | 1 | 3 |
| SUITED KING/QUEEN | 1 | 2 |
| SUITED KING/JACK | 1 | 2 |
| SUITED QUEEN/JACK | 1 | 2 |
| PAIR OF ACES | 2 | 7 |
| PAIR OF KINGS, QUEENS, OR JACKS | 1 | 4 |

*FIG. 2C*

300

| STARTING HAND TYPE (202) | PAY (212) | MULT (204) | FINAL HAND TYPE (304) | PAY (306) |
|---|---|---|---|---|
| 2 RED A'S | 1 | 6 | ROYAL FLUSH ON THE BOARD | 500 |
| SUITED A/K | 0 | 3 | ROYAL FLUSH | 100 |
| SUITED A/Q | 0 | 3 | STRAIGHT FLUSH | 50 |
| SUITED A/J | 0 | 2 | FOUR A'S | 25 |
| SUITED K/Q | 0 | 2 | FOUR 2'S THROUGH K'S | 10 |
| SUITED K/J | 0 | 2 | FULL HOUSE | 5 |
| SUITED Q/J | 0 | 2 | FLUSH | 4 |
| PAIR OF A'S | 1 | 5 | STRAIGHT | 3 |
| PAIR OF K'S, Q'S, OR J'S | 1 | 2 | THREE OF A KIND | 2 |
| | | | TWO PAIRS | 1 |

220 302 310 308

BET=1 312

*FIG. 3A*

320

| STARTING HAND TYPE (202) | PAY (212) | MULT (204) | FINAL HAND TYPE (304) | PAY (306) |
|---|---|---|---|---|
| 2 RED A'S | 5 | 6 | ROYAL FLUSH ON THE BOARD | 2500 |
| SUITED A/K | 0 | 3 | ROYAL FLUSH | 500 |
| SUITED A/Q | 0 | 3 | STRAIGHT FLUSH | 250 |
| SUITED A/J | 0 | 2 | FOUR A'S | 125 |
| SUITED K/Q | 0 | 2 | FOUR 2'S THROUGH K'S | 50 |
| SUITED K/J | 0 | 2 | FULL HOUSE | 25 |
| SUITED Q/J | 0 | 2 | FLUSH | 20 |
| PAIR OF A'S | 5 | 5 | STRAIGHT | 15 |
| PAIR OF K'S, Q'S, OR J'S | 5 | 2 | THREE OF A KIND | 10 |
| | | | TWO PAIRS | 5 |

220 302 310 308

BET=5 312

*FIG. 3B*

| HAND TYPE | MULT |
|---|---|
| 2 RED A | 6 |
| ⋮ | |
| PAIR A | 5 |
| PAIR J,Q,K | 2 |

| HAND TYPE | PAY |
|---|---|
| ROYAL FLUSH | 500 |
| ⋮ | |
| FLUSH | 10 |
| TWO PAIRS | 1 |

| HAND TYPE | MULT |
|---|---|
| 2 RED A | 6 |
| ⋮ | |
| **PAIR A** | **5** |
| PAIR J,Q,K | 2 |

| HAND TYPE | PAY |
|---|---|
| ROYAL FLUSH | 500 |
| ⋮ | |
| **FLUSH** | **10** |
| TWO PAIRS | 1 |

TOTAL PAYOUT = 10 X 5 = 50

| STARTING HAND CRITERIA | PAY | MULT |
|---|---|---|
| 2 RED A'S | 1 | 6 |
| **SUITED A/K** | 0 | **3** |
| SUITED A/Q | 0 | 3 |
| SUITED A/J | 0 | 2 |
| SUITED K/Q | 0 | 2 |
| SUITED K/J | 0 | 2 |
| SUITED Q/J | 0 | 2 |
| PAIR OF A'S | 1 | 5 |
| PAIR OF J'S, Q'S, K'S | 1 | 2 |

| HAND TYPE | PAY |
|---|---|
| ROYAL FLUSH ON BOARD | 500 |
| ROYAL FLUSH | 100 |
| STRAIGHT FLUSH | 50 |
| FOUR OF A KIND | 20 |
| **FULL HOUSE** | **5** |
| FLUSH | 4 |
| STRAIGHT | 3 |
| THREE OF A KIND | 2 |
| TWO PAIRS | 1 |

1000

| 1002 STARTING HAND TYPE | 1004 PAY($1_S$) | 1006 PAY($10_S$) | 1008 MULT | 1010 RESULTING HAND TYPE | 1012 PAY($1_R$) | 1014 PAY($10_R$) |
|---|---|---|---|---|---|---|
| 2 RED A'S | 1 | 10 | 6 | ROYAL FLUSH ON BOARD | 500 | 5000 |
| SUITED A/K | 0 | 0 | 3 | ROYAL FLUSH | 100 | 1000 |
| SUITED A/Q | 0 | 0 | 3 | STRAIGHT FLUSH | 50 | 500 |
| SUITED A/J | 0 | 0 | 2 | FOUR A'S | 25 | 250 |
| SUITED K/Q | 0 | 0 | 2 | FOUR 2'S THROUGH K'S | 10 | 100 |
| SUITED K/J | 0 | 0 | 2 | FULL HOUSE | 5 | 50 |
| SUITED Q/J | 0 | 0 | 2 | FLUSH | 4 | 40 |
| PAIR OF A'S | 1 | 10 | 5 | STRAIGHT | 3 | 30 |
| PAIR OF K'S, Q'S, OR J'S | 1 | 10 | 2 | THREE OF A KIND | 2 | 20 |
| | | | | TWO PAIRS | 1 | 10 |

EXAMPLE-1

| BET | HAND BET | TOTAL BET |
|---|---|---|
| 1 | 1 | 1 |

| STARTING HAND | PAY($1_S$) | MULT | RESULTING HAND | PAY($1_R$) | TOTAL PAYOUT |
|---|---|---|---|---|---|
| 4H,6D | 0 | 0 | 2 PAIRS | 1 | 1 |

EXAMPLE-2

| BET | HAND BET | TOTAL BET |
|---|---|---|
| 1 | 3 | 3 |

| STARTING HAND | PAY($1_S$) | MULT | RESULTING HAND | PAY($1_R$) | TOTAL PAYOUT |
|---|---|---|---|---|---|
| 2 RED A'S | 1 | 6 | 2 PAIRS | 1 | 6 |
| 2 RED A'S | 1 | 6 | FLUSH | 4 | 24 |
| 2 RED A'S | 1 | 6 | PAIR A'S | 0 | 1 |

EXAMPLE-3

| BET | HAND BET | TOTAL BET |
|---|---|---|
| 10 | 3 | 30 |

| STARTING HAND | PAY($10_S$) | MULT | RESULTING HAND | PAY($10_R$) | TOTAL PAYOUT |
|---|---|---|---|---|---|
| SUITED A/K | 0 | 3 | 2 PAIRS | 10 | 30 |
| SUITED A/K | 0 | 3 | 4 A'S | 250 | 750 |
| SUITED A/K | 0 | 3 | PAIR A'S | 0 | 0 |

*FIG. 10*

| HAND TYPE | MULT |
|---|---|
| 2 RED A | 6 |
| ⋮ | |
| PAIR A | 5 |
| PAIR J,Q,K | 2 |

1112

| HAND TYPE | PAY |
|---|---|
| ROYAL FLUSH | 500 |
| ⋮ | |
| FULL HOUSE | 15 |
| TWO PAIRS | 1 |

1110

| HAND TYPE | MULT |
|---|---|
| 2 RED A | 6 |
| ⋮ | |
| **PAIR A** | **5** |
| PAIR J,Q,K | 2 |

1114

1112

| HAND TYPE | PAY |
|---|---|
| ROYAL FLUSH | 500 |
| ⋮ | |
| **FULL HOUSE** | **15** |
| TWO PAIRS | 1 |

1122

TOTAL PAYOUT = 15 X 5 = 75

1630

| STARTING HAND TYPE | PAY-1 | PAY-2 | PAY-3 | MULT | FINAL HAND TYPE | PAY-1 | PAY-2 | PAY-3 |
|---|---|---|---|---|---|---|---|---|
| 2 RED A'S | 1 | 2 | 3 | 6 | ROYAL FLUSH | 100 | 200 | 300 |
| SUITED A/K | 0 | 0 | 0 | 3 | STRAIGHT FLUSH | 50 | 100 | 150 |
| SUITED A/Q | 0 | 0 | 0 | 3 | FOUR OF A KIND | 25 | 50 | 75 |
| SUITED A/J | 0 | 0 | 0 | 2 | FULL HOUSE | 5 | 10 | 15 |
| SUITED K/Q | 0 | 0 | 0 | 2 | FLUSH | 4 | 8 | 12 |
| SUITED K/J | 0 | 0 | 0 | 2 | STRAIGHT | 3 | 6 | 9 |
| PAIR OF A'S | 1 | 2 | 3 | 5 | THREE OF A KIND | 2 | 4 | 6 |
| PAIR OF K'S, Q'S, OR J'S | 1 | 2 | 3 | 2 | TWO PAIRS | 1 | 2 | 3 |

1625

APPARATUS AND METHOD FOR DETERMINING GAMING PAYOUTS USING PARTIAL GAME CRITERIA

This application claims the benefit of U.S. Provisional Application No. 60/634,877 filed Dec. 10, 2004, the content of which is incorporated herein by reference in its entirety.

FIELD OF THE INVENTION

This invention relates in general to games, and more particularly to apparatuses and methods for facilitating play in gaming activities and providing manipulation of payout awards based on partial game criteria.

BACKGROUND OF THE INVENTION

Card games such as poker have long been enjoyed as a means of entertainment. The popularity of casino gambling with wagering continues to increase, as does recreational gambling such as non-wagering computer game gambling. In some traditional cardroom poker games, players gather to compete against each other, and place bets that their poker hand will have a higher poker rank than the other players' hands. The highest poker rank in each played hand is the winner of the hand. If bets were made by the players, the winner collects the bets made by the losing players for that hand.

It may be the case that players would rather place their bets against the "house," rather than against each other. Some players would prefer not to be direct adversaries of other players for various reasons, including a lack of player-to-player poker skills, limiting controversy, etc. Other games such as video poker games may not involve other "actual" participants, although other "virtual" participants may be involved. For these and other reasons, it may be desirable to provide an avenue for participants to play against the house, at least with respect to the exchange of money.

However, when played in their conventional manner, some poker games are not particularly well suited for playing against the house. This may be due to various reasons. For example, the particular manner in which the game is traditionally played may present inherent difficulties in changing the game to a video version or house-banked version. Further, because other players may not be involved, some of the game excitement may be lost when playing against a dealer or participating in a video version. To address the different interests of different gaming participants, and to provide casinos and other gaming hosts with attractive alternatives, new slot machines games, poker games, and other gaming activities are continually sought after.

For example, "traditional" Hold'em poker implemented in a video poker format arguably does not have the allure of other poker counterpart games. This may be due to any number of reasons. One reason may be that until recently, Hold'em poker has not enjoyed the popularity of other forms of poker. However, due to the recent enormous increase in the popularity and exposure of Hold'em-type poker games played in table format, a potential demand is present for video alternatives.

Another drawback of traditional Hold'em poker when presented in video format is the lack of payout variation. While player anticipation and excitement is present as to the final hand that may be presented, video presentations generally lack the intra-hand betting interaction and/or other play variations. Thus, other than the face value of cards (or other symbols/indicia) that leads to the final outcome, player anticipation and excitement at earlier stages of the hand/activity is generally limited or otherwise nonexistent.

The shortcomings of the prior art are also applicable to other gaming activities. Accordingly, there is a need in the gaming industry for a manner of introducing anticipation and excitement for players participating in gaming activities at earlier stages in the card hand or other gaming activity. A further need exists to provide casinos or other gaming providers with the means to attract and retain players at video and table versions of such gaming activities. The present invention fulfills these and other needs, and offers other advantages over prior art gaming approaches.

SUMMARY OF THE INVENTION

To overcome limitations in the prior art described above, and to overcome other limitations that will become apparent upon reading and understanding the present specification, the present invention discloses apparatuses and methods for facilitating play in gaming activities and providing manipulation of payout awards based on partial game criteria.

In accordance with one embodiment of the invention, a method is provided for facilitating play of a gaming activity. The method involves awarding a bonus value based on a partial result of the gaming activity, if the partial result corresponds to any predetermined partial result(s). The gaming activity is completed to provide a complete result, and a payout is determined for the complete result. If the partial result corresponds to any of the predetermined partial results, the payout for the complete result is adjusted using the awarded bonus value to provide a final payout.

In accordance with one embodiment of the invention, a method is provided for facilitating play in a draw poker game. The method involves awarding a bonus value based on a partial hand including one or more cards of an initial draw poker hand, if the partial hand corresponds to any designated partial hand(s). The initial draw poker hand is completed to provide a final draw poker hand by replacing discarded cards (if any) from the initial draw poker hand. It is determined whether a poker hand payout is awarded based on the final draw poker hand. If the partial hand corresponds to any of the designated partial hands, the awarded poker hand payout is adjusted using the awarded bonus value to provide a final payout.

In more particular embodiments, the bonus value may involve mathematically applying an award value to the poker hand payout to arrive at the final payout. As a more specific example, mathematically applying the award value may involve multiplying the poker hand payout by the award value to arrive at the final payout. In other embodiments, a multiplier value based on the partial hand is awarded if the partial hand corresponds to any of the one or more designated partial hands. Other embodiments involve disregarding the adjustment to the awarded poker hand payout if the partial hand does not correspond to any of the designated partial hands. In another embodiment, a partial hand payout is awarded if the partial hand corresponds to any of the designated partial hands, even if the final draw poker hand does not result in an awarded poker hand payout. Thus, in some embodiments, a partial hand payout is awarded in addition to awarding the bonus value if the partial hand corresponds to any of the designated partial hands. In another embodiment, the user can select the partial hand from a plurality of possible partial hands.

In another embodiment of such a method, the partial hand payout is associated with at least one of the designated partial hands. This embodiment involves identifying that the partial hand corresponds to at least one of the designated partial hands having an associated partial hand payout, and that an awarded poker hand payout is less than the partial hand payout. In such a case, the poker hand payout may be disregarded, and the partial hand payout is awarded as the final payout.

In other particular embodiments, determining whether a poker hand payout is awarded based on the final draw poker hand involves comparing the final draw poker hand to multiple designated winning final draw hands. In an alternative embodiment, determining whether a poker hand payout is awarded based on the final draw poker hand involves comparing the final draw poker hand to at least one other player's final draw poker hand(s).

The partial hands may be specified in any number of ways in accordance with the invention. For example, the partial hand may be designated as one or more of the cards associated with the initial draw poker hand. In another example, the partial hand may be designated as the cards associated with one or more designated card positions of the initial draw poker hand, which may be static or unchanging card positions or may change from previous card positions. In other examples, the partial hand may be designated as one or more of the cards associated with the final draw poker hand (e.g., card number 1, card number 2, etc.), and/or one or more designated card positions of the final draw poker hand (e.g., card residing at position 1, card residing at position 2, etc.). In other examples, the partial hand may be designated as the cards associated with one or more of the replaced or "drawn" cards and/or positions associated with replaced/drawn cards. In another embodiment, the partial hand may be designated as one or more of the cards of the initial draw poker hand that are discarded from the initial draw poker hand, while in another embodiment the partial hand may involve those cards, and/or card positions, that are held and not discarded. In such cases, the designated partial hand(s) may include a number of cards less than or equal to a number of held/discarded cards of the initial draw poker hand. In some embodiments, at least some of the designated partial hands are associated with different bonus values. In some embodiments, at least one of the designated partial hands includes multiple cards of equal card rank, and in other embodiments it includes multiple cards of equal card rank but having at least a minimum card rank. In still other embodiments, at least one of the designated partial hands includes multiple consecutive cards based at least on card rank, while in other embodiments the designated partial hands are also based on card suit in addition to card rank. In other embodiments, at least one of the designated partial hands includes at least one card having a designated card rank, and/or a designated minimum card rank.

In one particular embodiment of such a method, the partial hand includes a group of one or more cards at respective positions of the initial draw poker hand, and the designated partial hand(s) include one or more designated groups of cards. The initial draw poker hand is completed by allowing one or more cards of the initial draw poker hand to be discarded and replaced by draw cards to create the final draw poker hand, The poker hand payout is determined by comparing the final draw poker hand to a paytable to determine the poker hand payout, if any, that corresponds to the final draw poker hand. The awarded poker hand payout is adjusted by adjusting the poker hand payout for the final draw poker hand using the awarded bonus value if the group of one or more cards corresponds to any of the designated groups of cards.

In accordance with another embodiment of a method according to the invention, a method for facilitating play in a multi-hand draw poker game is provided. In such a case, a bonus value is awarded for qualifying ones of a plurality of partial hands, each which includes one or more cards of a respective plurality of initial draw poker hands, where the qualifying partial hands correspond to one or more designated partial hands. Each of the initial draw poker hands is completed to provide respective final draw poker hands by replacing zero or more cards discarded from each of the initial draw poker hands. It is determined whether a poker hand payout is awarded for each of the final draw poker hands. If any of the partial hands correspond to any of the one or more designated partial hands, any awarded poker hand payouts is adjusted using the respective awarded bonus values to provide respective final payouts.

In accordance with another embodiment of the invention, a computer-implemented poker apparatus is provided for allowing player participation in an electronic draw poker game. The poker apparatus includes a display, a first paytable identifying one or more predetermined partial hands and corresponding bonus values for each of the predetermined partial hands, and a second paytable identifying one or more predetermined final draw poker hands and corresponding resulting payouts for each of the predetermined final draw poker hands. It should be noted that the first and/or second paytables may or may not be made known to the player. The poker apparatus also includes a processor (which may involve one or more processing components) configured to present via the display at least one initial draw poker hand, to compare a subset of the initial draw poker hand to the one or more predetermined partial hands of the first paytable, to award a corresponding one of the bonus values if the comparison results in a match, to provide replacement cards for any discarded cards of the initial draw poker hand and in response arrive at a final draw poker hand, and to use the awarded bonus value to adjust any payout resulting from a match of the final draw poker hand and the second paytable.

In more particular embodiments of such a poker apparatus, the processor is configured to direct the display to present multiple initial draw poker hands, and further provides a user interface to facilitate player selection of at least one of the initial draw poker hands. In another embodiment, the bonus values involve multiplier values, where the first paytable includes a list of the predetermined partial hands and their corresponding multipliers. In a particular embodiment, the bonus values may include fixed payout values payable to the player if the final draw poker hand does not match any of the predetermined final draw poker hands of the second paytable. In another embodiment, the bonus values include fixed payout values payable to the player if the final draw poker hand provides a payout that is less than the fixed payout value.

In accordance with another embodiment of the invention, a method is provided for facilitating play in a slot game. The method includes awarding a bonus value based on a partial result including a group of one or more first symbols at respective designated reel locations of a slot game activity, if the partial result corresponds to any of one or more predetermined partial results. The slot game activity is completed to provide a complete result by presenting second symbols in at least some remaining reel locations to reveal one or more resulting paylines. Such paylines may be any type of payline, such as horizontal, vertical, diagonal, adjacent squares, "around the corner" paylines, scatter paylines, etc. A slot game activity payout for the complete result is determined, and the slot game activity payout for the one or more resulting paylines is adjusted using the awarded bonus value if a bonus value was awarded.

In particular embodiments of such a method, awarding a bonus value may involve providing an award value and mathematically applying the award value to the slot game activity payout to arrive at a final payout. In a more particular embodiment, mathematically applying the award value may involve multiplying the slot game activity payout by the award value to arrive at the final payout.

In other particular embodiments, awarding a bonus value involves awarding a multiplier value based on the partial result if the partial result corresponds to any of the one or more predetermined partial results. In other embodiments, the designated reel locations may be designated prior to initiation of the slot game activity, or may be randomly designated during the slot game activity such that they change from time to time. In such a random designation during the slot game activity, this may involve distinguishing the designated reel locations from the remaining reel locations in connection with the slot game activity, which may occur from highlighting or otherwise distinguishing the designated reel locations from the other reel locations.

In still other embodiments, determining a slot game activity payout for the complete result involves comparing the resulting one or more resulting paylines to a paytable to determine the slot game payout, if any, that corresponds to the one or more resulting paylines. In other embodiments, the designated and remaining reel locations present the respective first and second symbols via one or more mechanical reels, where in other embodiments this is presented via electronic reels.

In still other particular embodiments of such a method, the resulting payline(s) include at least one of the first symbols of the partial result. In other embodiments, it is determined whether the partial result corresponds to any of one or more predetermined partial results before the second symbols have been presented in the remaining reel locations. In still other embodiments, the reels associated with the first symbols are stopped (e.g., stop spinning or appear to be spinning or otherwise obscured) while one or more remaining reels continue to spin. In a more particular embodiment, it is further determined whether the partial result corresponds to any of one or more predetermined partial results before the second symbols have been presented in the remaining reels.

In other particular embodiments of such a method, an absolute bonus amount is awarded based on the partial result in addition to awarding the bonus value, if the partial result corresponds to any of the one or more predetermined partial results. In a more particular embodiment, a final payout is determined based on the sum of the adjusted slot game activity payout and the absolute bonus amount.

In another embodiment of such a method, adjusting the slot game activity payout using the awarded bonus value if a bonus value was awarded involves adjusting the slot game activity payout for the one or more resulting paylines that include any of the first symbols. In another embodiment, adjusting the slot game activity payout using the awarded bonus value if a bonus value was awarded involves adjusting the slot game activity payout for the one or more resulting paylines that include all of the first symbols, while in another embodiment the adjustment involves adjusting the slot game activity payout for any of the resulting paylines that involve a slot game activity payout.

In one embodiment, the designated reel locations are provided as part of a common symbol grid also including the remaining reel locations. In other embodiments, the designated reel locations may be provided as a separate symbol grid distinct from the remaining reel locations from which the slot game activity occurs. Some embodiments allow the user to select one or more of the designated reel locations where the partial result will be presented.

In accordance with another embodiment of the invention, a method is provided for facilitating play of a gaming activity, where a bonus value is awarded based on a partial result of the gaming activity, if the partial result corresponds to any of one or more predetermined partial results. The gaming activity is completed to provide a complete result, and a payout is determined for the complete result. If the partial result corresponds to any of the one or more predetermined partial results, the payout is adjusted for the complete result using the awarded bonus value to provide a final payout. In such an embodiment, the gaming activity is a slot game, the partial result of the slot game involves a group of one or more symbols at respective reel locations, and the one or more predetermined partial results include one or more predetermined symbol combinations. The method further includes completing the slot game to provide a complete result by presenting additional symbols at additional reel locations to reveal resulting paylines, and determining the payout for the complete result by comparing the resulting paylines to a paytable to determine the payout, if any, that corresponds to the resulting paylines. The method further involves adjusting the payout for the resulting paylines using the awarded bonus value if the group of one or more symbols corresponds to any of the one or more predetermined symbol combinations.

In accordance with another embodiment of the invention, a computer-implemented gaming apparatus is provided for allowing player participation in an electronic slot game activity. The gaming apparatus includes a display, a first paytable identifying one or more predetermined partial results and corresponding bonus values for each of the predetermined partial results, and a second paytable identifying one or more predetermined complete results and corresponding resulting payouts for each of the predetermined complete results. The first and/or second paytable may, or may not, be made known to the user. A processing arrangement is configured to direct the display to present at least one partial result including a group of one or more first symbols at respective designated reel locations of the slot game activity, to award a bonus value based on the partial result if the partial result matches any of the predetermined partial results of the first paytable, to complete the slot game activity to provide a complete result and corresponding payout for the complete result, and to adjust the payout for the complete result using the awarded bonus value to provide a final payout if a bonus value was awarded.

In a more particular embodiment of such a gaming apparatus, the processor is configured to award a multiplier as the bonus value when the partial result matches any of the predetermined partial results, and is further configured to adjust the payout for the complete result by multiplying the multiplier and the payout to arrive at the final payout. In a more particular embodiment, the processor is further configured to award a fixed bonus amount based on the partial result in addition to the multiplier when the partial result matches any of the predetermined partial results, and is further configured to adjust the payout for the complete result by multiplying the multiplier and the payout and adding the fixed bonus amount to arrive at the final payout. In another embodiment, a user interface is provided to facilitate at least player selection of the designated reel locations in which the partial result will be presented.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described representative examples of systems, apparatuses, and methods in accordance with the invention.

BRIEF DESCRIPTION OF THE DRAWINGS

The invention is described in connection with the embodiments illustrated in the following diagrams.

FIGS. 2A, 2B and 2C illustrate representative examples of paytables that may be used as the auxiliary bonus criteria for the partial results of the gaming activity;

FIGS. 3A and 3B illustrate additional paytable examples further including paytables relating to exemplary final outcomes of the gaming activity;

FIG. 10 illustrates an example of how total payouts may be calculated in view of varying bet amounts and varying numbers of concurrent hands played;

DETAILED DESCRIPTION OF THE INVENTION

In the following description of various exemplary embodiments, reference is made to the accompanying drawings which form a part hereof, and in which is shown by way of illustration various embodiments in which the invention may be practiced. It is to be understood that other embodiments may be utilized, as structural and operational changes may be made without departing from the scope of the present invention.

Generally, the present invention provides a manner of introducing bonus or otherwise additional payout awards into gaming activities. In various forms, the invention utilizes a subset(s) of the gaming elements/items otherwise associated with the gaming activity to determine whether a conditional payout increase, contingent upon a final result of the gaming activity, will be awarded. The invention may be integrated with a variety of different known gaming activities, or introduced into new gaming activities, where such a subset(s) of the gaming elements is already available or can be devised.

Figure 1:
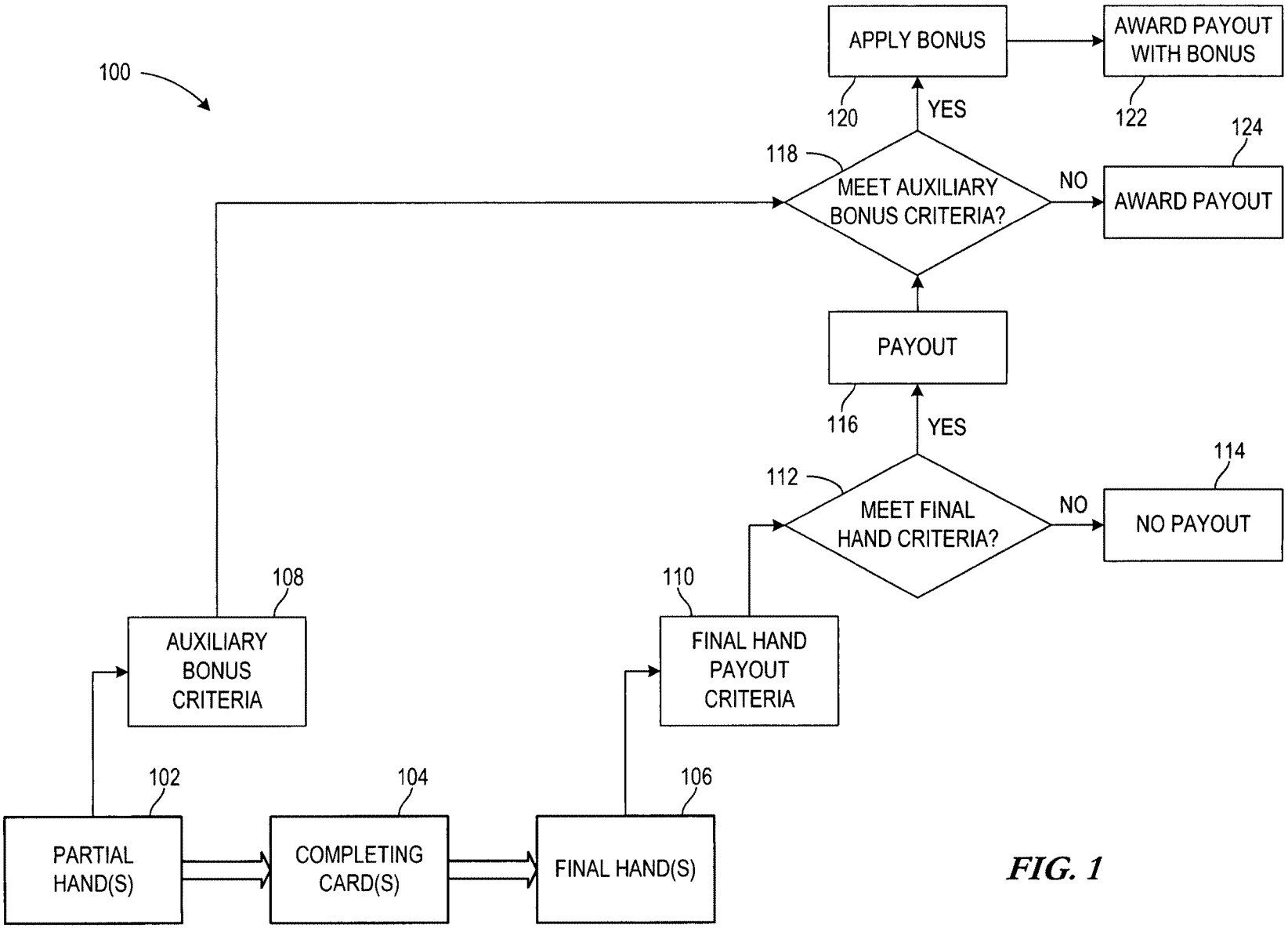
FIG. 1 illustrates a representative manner for facilitating play in a gaming activity, and enabling payout awards to be manipulated based on partial game criteria, in accordance with one embodiment of the present invention.

FIG. 1 illustrates one embodiment of a manner for facilitating play in a gaming activity, and enabling payout awards to be manipulated based on partial game criteria. In the illustrated embodiment, a poker game 100 is depicted, which includes a partial hand(s) 102, one or more completing cards 104, and a final or "resulting" hand(s) 106. A partial hand 102 may be represented by, for example, the starting hand or "hole cards" in a Hold'em poker game. The completing cards 104 represent any cards that are available for use together with the partial hand 102 in creating a final or resulting hand 106. For example, the completing cards may represent the community cards in a Hold'em poker game. In a Hold'em context, the resulting hand 106 may be derived from the set of cards comprising the partial hand 102 (e.g., hole cards) and the completing cards 104 (e.g., community cards).

Various games such as Hold'em poker, draw poker, blackjack, and the like often include a first set or group of cards that are provided to the player. Additional cards are generally provided to provide the player with an opportunity to better his/her hand, in an ultimate effort to maximize a resulting payout award. Some games such as Hold'em poker may allow multiple bets to be placed during play of the hand, such as upon receipt of the hole cards, and again after each of the flop, the turn, and the river. However, such wagers are merely additive wagers placed on only what the final hand will be. The particular cards provided along the way to the final hand are irrelevant in and of themselves, and are relevant only at the time that the final hand is derived from the aggregation of the cards. This holds true for other poker games as well, such as draw poker, blackjack, etc.

The present invention provides, among other things, a manner of making a subset(s) of the cards in such games independently relevant of the final result, while still impacting the final result. An example is shown in FIG. 1, which is described in terms of a poker game. The partial hand(s) 102 may be a natural starting hand such as in the case of the hole cards in Hold'em, or may be established in advance such as particular dealt cards, the dealt location of cards, and/or other predetermined criteria. In the embodiment of FIG. 1, auxiliary bonus criteria 108 are established. These criteria 108 may be established in any manner, such as by way of a paytable. An example is shown in TABLE 1 below:

TABLE 1

| AUXILIARY BONUS CRITERIA | BONUS VALUE |
|---|---|
| 2 Red Aces | W |
| Suited Ace/King | X |
| Pair of Aces | Y |
| Pair of Kings, Queens, or Jacks | Z |

Thus, the auxiliary bonus criteria of "2 Red Aces" indicates that if the partial hand 102 includes or equals 2 Red Aces, a bonus value of "W" will apply. For example, the bonus value W may correspond to a multiplier of five. This will be described more fully below.

Payouts for the final hand 106 are also determined by predetermined final hand payout criteria 110, such as poker rank, as shown in the example paytable of TABLE 2:

TABLE 2

| FINAL HAND | PAY |
|---|---|
| Royal Flush | A |
| Straight Flush | B |
| . . . | . . . |
| Two Pairs | n. |

Thus, if a player's final hand 106 is complete, it is determined 112 whether the player's final hand 106 meets any of the final hand payout criteria 110. If it does not, then no payout 114 is awarded. Assume for purposes of example that the final hand 106 includes a Straight Flush, and a Straight Flush is part of the payout criteria 110 as it is in the example of TABLE 2. In such case, the player's final hand 106 meets the final hand criteria, and the player would be awarded a payout 116 equal to some value shown as "A" in TABLE 2.

In accordance with the present invention, the payout 116 may be adjusted based on the partial hand(s) 102 occurring prior to formulation of the final hand(s) 106. For example, if the partial hand 102 meets the auxiliary bonus criteria 108 as determined at decision block 118, the bonus is applied 120, and the payout is awarded with the bonus applied as shown at block 122. If a payout 116 applies but the bonus criteria have not been met, then only the payout is awarded 124 in the illustrated embodiment. More particular examples are provided in the ensuing description.

FIGS. 2A, 2B and 2C illustrate representative examples of paytables that may be used as the auxiliary bonus criteria for the partial results of the gaming activity. For purposes of example and not of limitation, these figures are described in the context of a Hold'em poker game where the partial hand is represented by the starting hand or "hole cards." The first paytable 200 of FIG. 2A includes a number of predetermined starting hand types as shown in column 202. Assuming two hole cards as is the case in most Hold'em-style poker games, these starting hand types may include, for example, two red Aces, suited cards such as a suited Ace/King, pairs such as pairs of Aces, Kings, Queens, Jacks, and/or other predetermined card combinations. In accordance with the invention, at least some or all of these predetermined card combinations are associated with a bonus value, which in the exemplary paytable 200 is a multiplier as shown in column 204, although it could represent other mathematical functions and/or combinations of mathematical functions. It should be noted that the particular multiplier values in column 204 may, or may not, be dependent on the amount wagered by the player. Further, the multiplier may be an integer value, or may be any number including fractional values (e.g., 1.5, 2½, etc.).

For paytable 200, receiving a suited Ace/King as the starting hand would specify a multiplier of "5" as the bonus value. Similarly, a pair of Aces as the hole cards would specify a multiplier of "7." When a player receives a starting hand that corresponds to any of the predetermined starting hand types designated in the paytable 200 column 202, the player will be awarded the corresponding multiplier. It should be noted that the "award" of this multiplier does not, in and of itself, provide the player with any current return or payout. Rather, this multiplier is in essence "reserved" for the player, and is used later in the hand to adjust a subsequent payout amount. For example, if the player wins a payout of $10 based on his/her final hand, and the multiplier of "5" was previously awarded to that player during that hand, then the player would win a total payout of $10×5=$50. In one embodiment, if the player's final/resulting hand did not result in a payout, then the multiplier would have no effect (e.g., $0×5=$0).

However, the bonus value awarded to the player may also include a non-contingent award as well. Paytable 210 of FIG. 2B illustrates one such example. In this example the bonus value provides a fixed or relative payout, which may be used in addition to serving as a multiplier or other bonus function. Using reference numbers analogous to those of FIG. 2A where appropriate, the starting hand column 202 includes a number of predetermined starting hand types as previously described. A bonus value in the "pay" column 212 provides a payout amount for one or more of the starting hand types. For example, where the player's starting hand includes a pair of Aces, a pay amount is shown as "2." This value may represent dollars, tokens, credits, and/or the like. The value may, or may not, be dependent on an amount wagered by the player. For example, where the player wagers 2 credits, the "pay" column 212 may be as illustrated on paytable 210, but where the player wagers 4 credits the pay column 212 may be doubled.

Paytable 220 of FIG. 2C illustrates an example implementing combined partial hand bonus criteria. Paytable 220 includes the starting hand type 202, pay column 212, and multiplier 204. For example, in a Hold'em embodiment where the player receives two red Aces as his/her hole cards, the player will be awarded a payout of "3" units (e.g., credits), and a multiplier of "10" will be reserved for use in calculating a total payout when the player's final hand is complete.

It should be noted that the paytables 200, 210, 220 of FIGS. 2A, 2B and 2C are merely representative examples. Any predetermined, or even partially random, hand types and corresponding bonus values may be utilized. In many cases, the starting hand types and corresponding bonus values are at least in part dependent upon the mathematical payout criteria.

FIGS. 3A and 3B illustrate additional paytable examples, and further include paytables relating to the final outcome of the gaming activity. Referring first to paytable 300 of FIG. 3A, and again using reference numbers from FIGS. 2A, 2B and 2C where appropriate, a first portion of the paytable 300 includes a paytable 220 similar to that described in connection with FIG. 2C. This portion 220 includes the starting hand type 202, pay column 212, and multiplier column 204 as previously described. The paytable 300 further includes a second portion 302 that includes a listing of the final hand types 304 that will produce a payout. The particular payout for a particular hand type is shown in the pay column 306. For example, four Aces (FOUR A'S) will provide a 25 unit payout.

From the paytable 300, a total payout award may be calculated for a player for a particular hand. As an example in the Hold'em context, assume the player receives a pair of Kings (K,K) as the hole cards. The player will be awarded a payout of "1" unit as seen at the intersection of row 308 and column 212. A multiplier value of "2" will also be awarded to the player as seen at the intersection of row 308 and column 204. As play continues, assume the player's final hand is a full house (e.g., K,K,3,3,3). As seen at the intersection of row 310 and column 306, the player will be awarded a payout of "5" units. The player's final payout will therefore be as shown in EQUATION 1 below:

$$PAY_{COLUMN\ 212}+(PAY_{COLUMN\ 306}\times MULT_{COLUMN\ 204})=1+(5\times 2)=11 \qquad \text{EQUATION 1}$$

It should be noted, however, that other embodiments of the invention provide the $PAY_{COLUMN\ 212}$ only if the resulting hand does not provide a greater amount. In other words, in one embodiment, the pay 212 amount will be paid to the player if the player does not ultimately obtain a resulting hand that provides a payout. In such an embodiment, the PAY amounts shown in column 212 are provided as a default payment for meeting one of the starting hand criteria 202, when the awarded multiplier or other bonus value obtained cannot be applied because it is contingent upon receiving a payout on the resulting hand. In another embodiment, the $PAY_{COLUMN\ 212}$ is provided only if the resulting hand does not provide any amount. Such an embodiment is shown in EQUATION 2 below:

$$\text{If } PAY_{COLUMN\ 306}=0,\text{Final Payout}=PAY_{COLUMN\ 212}=1 \text{ Else } PAY_{COLUMN\ 306}\neq 0,\text{Final Payout}=(PAY_{COLUMN\ 306}\times MULT_{COLUMN\ 204})=5\times 2=10 \qquad \text{EQUATION 2}$$

EQUATION 1 assumes a first player wager amount, such as a bet of "1" as shown by bet block 312. Paytable 320 of FIG. 3B, on the other hand, assumes a different player wager amount, such as a bet of "5" as shown by bet block 312. Certain payouts and/or bonus values may be increased proportionally to the wager, or increased in some manner, as the player's wager increases. In the illustrated embodiment of FIG. 3B, the pay column 212 has increased proportionally to the increased wager as compared to FIG. 3A. More particularly, because the player bet is "5" in the example of FIG. 3A, and the player bet is "1" in the example of FIG. 3A, some of the payout amounts are increased by a factor of "5" in the example of FIG. 3B. Specifically, the pay column 212 has been increased by a factor of "5" over the pay column 212 of FIG. 3A, and the pay column 306 of FIG. 3B has also increased by a factor of "5" over the pay column 306 of FIG. 3A. It is noted that in the illustrated example, the multiplier values in column 204 of FIGS. 3A and 3B did not change as a result of the increased bet amount 312, although it could also change if desired.

Figure 4A:
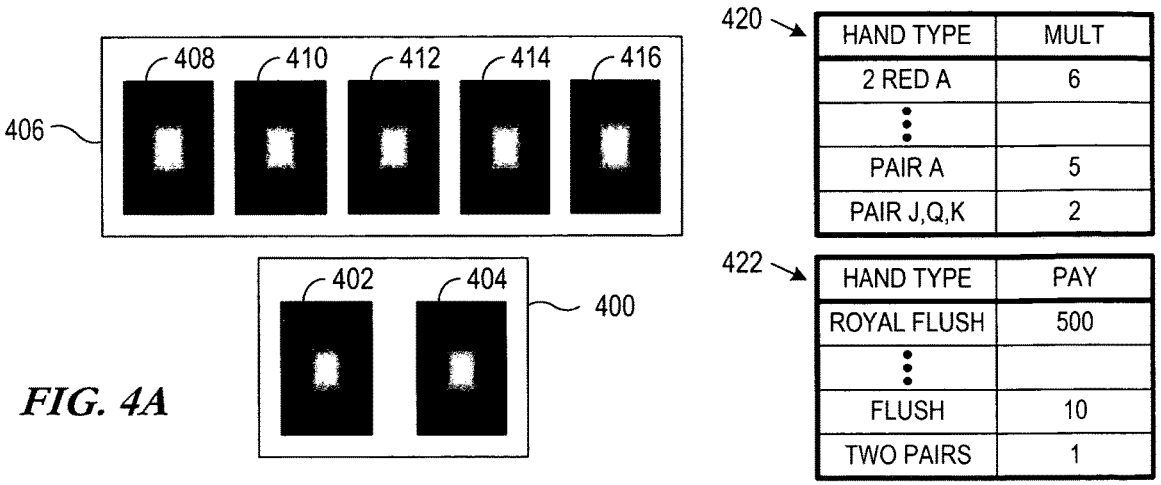
FIGS. 4A, 4B and 4C are diagrams illustrating a progression of a Hold'em poker hand played in accordance with one embodiment of the present invention.
Figure 4B:
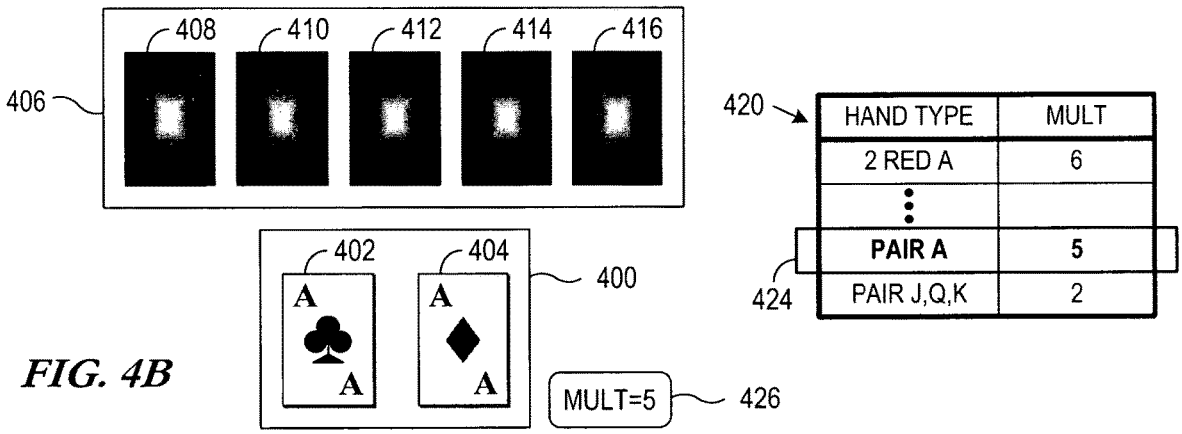
Figure 4C:
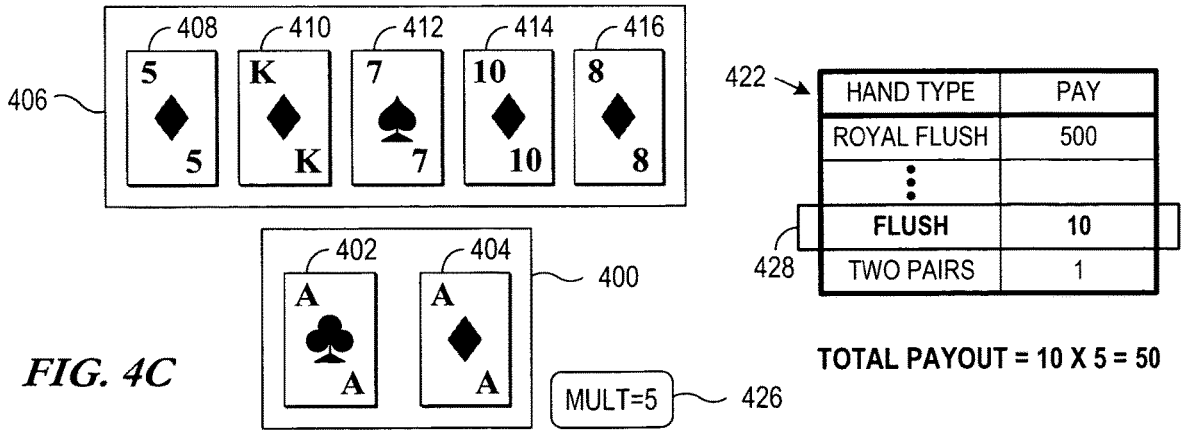

FIGS. 4A, 4B and 4C are diagrams illustrating a progression of a Hold'em poker hand played in accordance with one embodiment of the present invention. As will be described more fully below, various options may exist such as allowing user selection among a plurality of available starting hands, playing multiple hands simultaneously using multiple community card hands, etc. For purposes of illustration and not of limitation, the embodiment of FIGS. 4A, 4B and 4C are illustrated using a single starting hand and a single community card hand. Further, the principles described in connection with FIG. 4A are equally applicable to other community card games involving a partial/starting hand. It should also be noted that the term "community" when used herein in the context of community cards, community hand, community card games and the like is a term used in the art to represent additional cards, often referred to as the "board." The use of the term "community" does not, as used herein, necessarily require that these additional cards or board(s) be available for use with multiple players, although this may be the case. Thus, in embodiments involving a single player or multiple players, the community hand represents the additional presented cards that are available to the single or multiple players in creating their respective resulting hand(s). In other words, in some embodiments of the invention the "community" cards do not necessarily need to be "shared" by multiple players, such as in an embodiment where a single participant is participating in the game. In multi-player embodiments, the community cards may indeed be shared by multiple players.

As shown in FIG. 4A, the starting hand 400 includes two cards 402, 404 in the illustrated embodiment, although a smaller or larger number may be used. The board 406 represents the community cards that are used as additional cards to assist in creating the player's final or resulting hand. In the illustrated embodiment, five community cards 408, 410, 412, 414, 416 constitute the board 406, although a smaller or larger number of community cards may be used. A starting hand paytable 420 is provided, which identifies predetermined starting hand types and corresponding multiplier values. Resulting hand paytable 422 identifies predetermined resulting hands and corresponding payout amounts.

Referring to FIG. 4B, the player has received a pair of Aces (A,A) as cards 402, 404 of the starting hand 400. The paytable 420 indicates that the player will therefore be entitled to multiply any payout associated with a resulting hand by "5" as shown at row 424. In some embodiments, any received multiplier value may be displayed to the player as shown by presentation field 426. This may be particularly useful in a video embodiment, although it may be used in live table embodiments as well. Alternatively, the multiplier may simply be used in the total payout calculation without any specific presentation. In the illustrated example, no starting hand payout is provided (see, e.g., column 212 of FIGS. 2B, 2C, 3A, 3B), although in other embodiments such a starting hand payout may be provided.

FIG. 4C illustrates a final progression stage of the poker hand, where the cards 408, 410, 412, 414, 416 of the board 406 are exposed. The cards of the board 406 may all be exposed at once, or may be exposed sequentially, or in any predetermined manner. In one embodiment, additional bets are allowed such that the player may place additional bets after one or more of the cards 408-416 are exposed. For example, the first three cards 408, 410, 412 (i.e., the flop) may be exposed, and the player may place an additional bet. The fourth card 414 (i.e., the turn) may be exposed, allowing the player to place another bet. The last card 416 (i.e., the river) may then be exposed, and further bets may be placed. This is dependent on the particular implementation. For example, the additional bets may be implemented in embodiments where multiple players are participating against each other, and additional total payouts due to the existence of a multiplier are paid by the house (in which case monies are paid to the house to fund such payouts). In a slot machine context, there may not be such additional wagers, and exposing the cards of the board 406 may be performed in any desired manner (e.g., all at once, sequentially, etc.).

In the illustrated embodiment of FIG. 4C, the player's resulting hand is derived using a number of cards (five in the present example) selected from the total cards in the starting hand 400 and board 406. In the illustrated embodiment, the player has received a Flush of diamonds (A, K, 10, 8, 5 of diamonds). From the resulting hand paytable 422, it can be seen at row 428 that a Flush pays "10" units. In accordance with the present invention, the previous multiplier of "5" awarded to the player as a result of the qualifying starting hand 400 is multiplied by the "10" units awarded to the player as a result of the player's resulting hand. Thus, the total payout is "10" units times the multiplier of "5" for a total payout of "50."

It is interesting to note that the "pair" of Aces received in the starting hand 400 resulted in a multiplier that caused an additional payout amount, even though the "pair" of Aces in the starting hand 400 were not used in the resulting hand (only the Ace of diamonds was used). Thus, in this embodiment, the multiplier is awarded regardless of how the starting hand cards (that gave rise to the multiplier) are ultimately used. In fact, the multiplier still applies even if none of the starting hand cards 402, 404 are used in the resulting hand (e.g., a three-seven Straight occurs on the board 406 cards).

In another embodiment, the multiplier or other bonus value may be used only where all of the starting hand cards are ultimately used in the resulting hand. For example, where a pair of Aces is received in the starting hand 400 giving rise to a multiplier of "5," a resulting hand utilizing that pair of Aces will allow the multiplier to be used. More particularly, resulting hands including four Aces, a full house, three of a kind, two pair, or other designated poker rank that includes the two Aces 402, 404 will give rise to the use of the multiplier.

Figure 5:
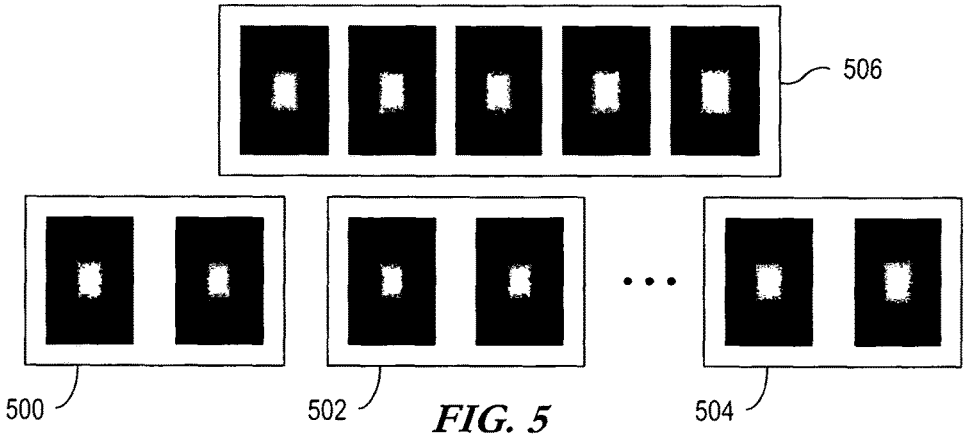
FIG. 5 illustrates an embodiment of the invention allowing player selection of a partial result from a plurality of available partial results.

The present invention may be implemented with various alternative embodiments. One such alternative embodiment is to allow the player to select a starting hand(s) from a plurality of starting hands. FIG. 5 generally illustrates such an embodiment. As can be seen, a plurality of starting hands 500, 502 through 504 may be presented to the user. The number presented to the user may be two, three, or any other number from which a reasonable selection may be made. The cards of each of the starting hands 500, 502, 504 may be presented face up, face down, some face up and some face down, or in any desired manner. In one embodiment of the invention, the plurality of starting hands 500, 502, 504 are each presented face up, thereby allowing the player to select the starting hand that is believed to be the most likely to result in a favorable resulting hand, and/or the starting hand that is associated with a bonus value (e.g., multiplier) or the highest bonus value if multiple starting hands are associated with bonus values. The selected starting hand is then used in combination with the hand of community cards, i.e., the board 506, to derive the resulting hand. It should also be noted that in some embodiments, multiple starting hands may be selected by the player, such as in an embodiment where the player is allowed to participate (with or without multiple wagers) in multiple hands by playing multiple starting hands.

Figure 6:
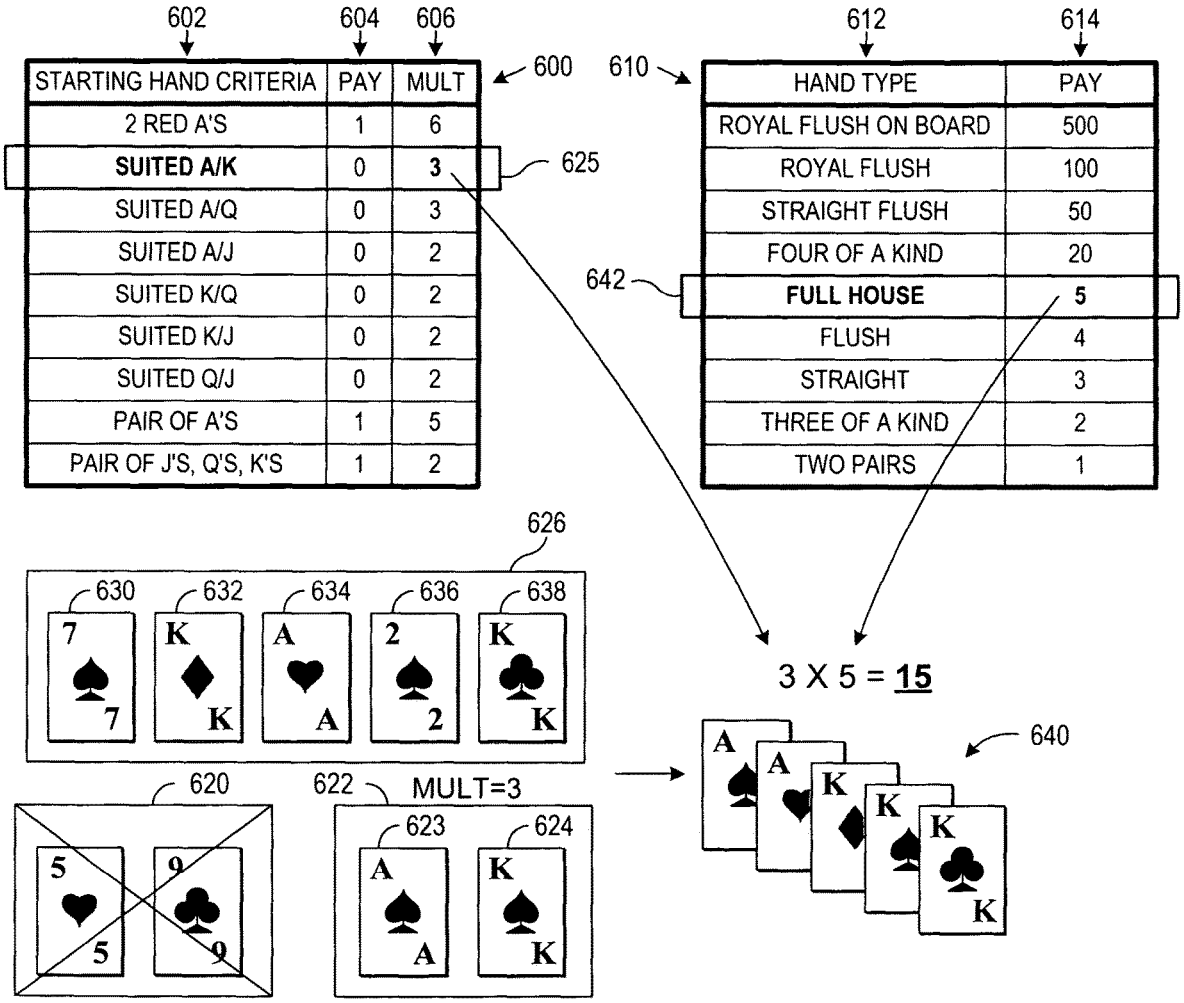
FIG. 6 illustrates an embodiment of the invention allowing player selection of a starting hand from a plurality of available starting hands in a poker embodiment.

FIG. 6 illustrates a more particular embodiment of the invention involving selection of a starting hand. In this embodiment, a starting hand paytable 600 is provided, which lists the starting hand criteria 602, as well as a payout 604 and multiplier 606 if the player's selected starting hand matches one of the predetermined starting hands in column 602. A resulting hand paytable 610 is also provided, which lists the resulting hand criteria 612, as well as the payout 614 to be awarded to the player if the player's resulting hand matches one of the predetermined resulting hands in column 614.

As illustrated in FIG. 6, the player has been presented with (e.g., dealt) two possible starting hands 620, 622, although a larger number may have been dealt. Starting hand 620 does not meet the starting hand criteria 602, and therefore has no pay 604 or multiplier 606 associated therewith. On the other hand, starting hand 622 includes a suited Ace/King 623, 624 (A,K Spades), which matches one of the starting hand criteria 602 as shown at row 625. This particular starting hand has a "pay" 604 value of "0," meaning that no automatic payout is awarded for achieving this particular starting hand. However, a multiplier of "3" is awarded for this starting hand 622. In the illustrated embodiment, the player selects starting hand 622. This selection may be made in any known manner, whether played via a live table version or slot machine version. For example, in a slot machine embodiment, the user may select the desired starting hand 622 using any known user interface mechanism, such as a button, pointer, touchscreen, voice command, etc.

The board 626 in the illustrated embodiment includes five cards 630, 632, 634, 636, 638. Using five of the total seven cards to derive the best possible resulting hand, a Full House becomes the resulting hand 640 (i.e., two Aces, three Kings). A Full House is listed on the resulting hand paytable 610, and provides a payout of "5" as shown at row 642. Therefore, the previously awarded multiplier of "3" shown at row 625, taken times the payout value of "5" shown at row 642, results in a total payout of 15 units.

It is noted that had the player selected the other starting hand 620, the player would not have been awarded any bonus value (e.g., multiplier), nor would the player have won any payout. In one embodiment of the invention, the non-selected starting hand(s) is still displayed to the player, so that the player can see what would have been won had he/she selected a different starting hand.

In one embodiment, the cards of the starting hand that are not selected, such as starting hand 620, are not "returned to the deck(s)" of cards that are subsequently used for the board cards 626 in another embodiment, the cards of the starting hand that are not selected, such as starting hand 620, are returned to the deck(s) of cards and are therefore available for use as cards of the board 626.

Figure 7:
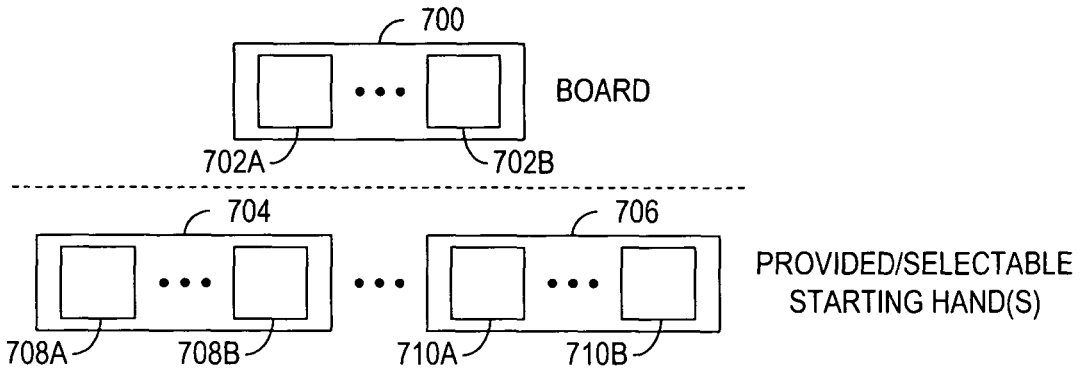
FIG. 7 generally illustrates the applicability of the present invention in, among other things, a variety of poker games including one or more starting hands and additional cards such as one or more community cards.

As seen above, the present invention is particularly interesting in the context of Hold'em poker games. As shown in FIG. 7, the present invention is applicable in any Hold'em-type poker game where at least one board 700 including one or more cards 702A . . . 702B, and one or more provided or selectable starting hands 704, 706 each including one or more cards 708A . . . 708B, 710A . . . 710B respectively. Other alternatives also exist, and the invention may be applied in other environments beyond community card poker games such as Hold'em. Some representative examples of such alternatives and different environments follow.

Figure 8:
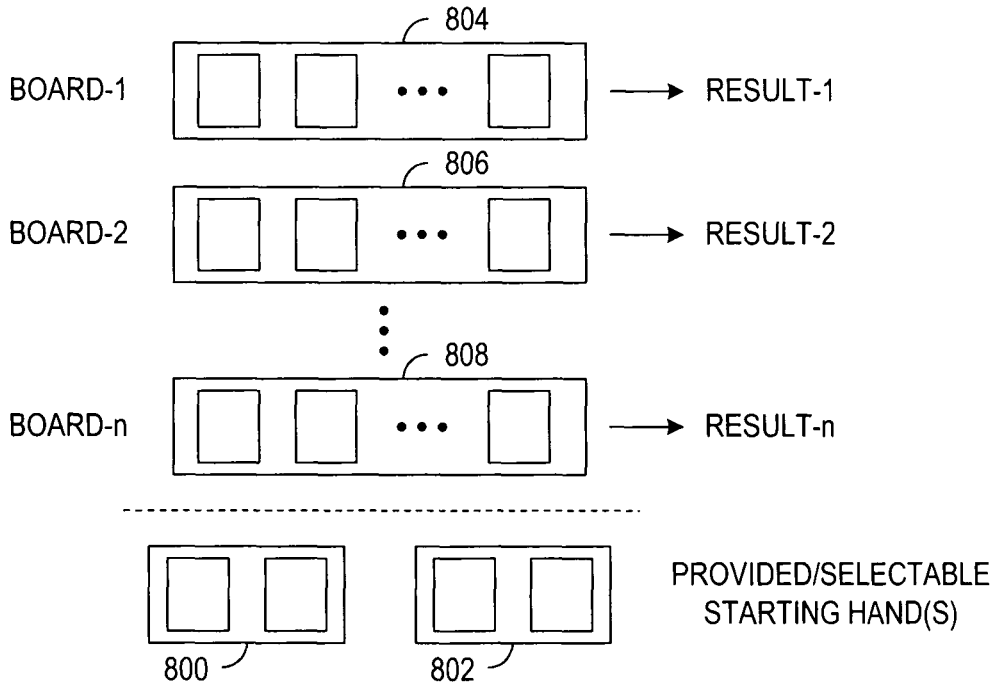
FIG. 8 illustrates an alternative embodiment of a Hold'em-type poker game implementing the principles of the present invention, and facilitating multi-hand play by the participant(s) of the game.

FIG. 8 illustrates an alternative embodiment of a Hold'em-type poker game implementing the principles of the present invention, and facilitating multi-hand play by the participant(s) of the game. Again, one or more provided or selectable starting hands 800, 802 are provided. In the illustrated embodiment, multiple boards 804, 806 through 808 are provided to allow the player to simultaneously participate in multiple hands. There may be one board, two boards, three boards, or any number of boards that is reasonable in the gaming context. Multiple boards may be presented as a standard part of the game, or may be presented upon user selection of participating in multiple games, which may require additional wagers by the player. For example, if a wager of a single unit allows participation in one hand with one board 804, then a wager of three units may allow for participation in three hands with three boards 804, 806, 808. More particular examples are set forth in FIG. 9.

Figure 9:
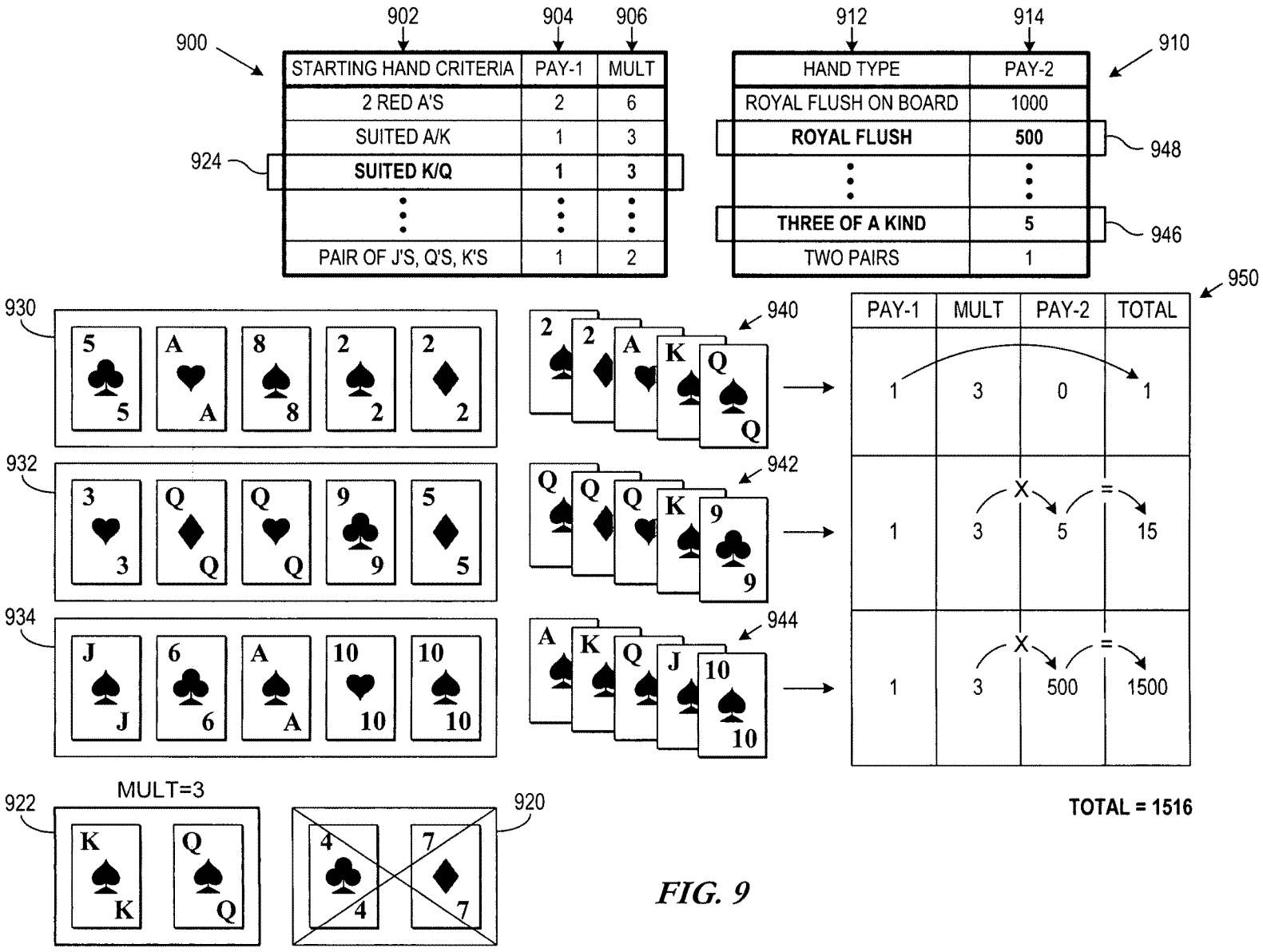
FIG. 9 illustrates another embodiment of a Hold'em-type poker game wherein multi-hand play by the participant is allowed through participation with multiple boards and/or multiple starting hands.

In the representative embodiment of FIG. 9, a starting hand paytable 900 is provided, which lists the starting hand criteria 902, as well as a payout (PAY-1) 904 and multiplier (MULT) 906 if the player's selected starting hand matches one of the predetermined starting hands in column 902. A resulting hand paytable 910 is also provided, which lists the resulting hand criteria 912, as well as the payout (PAY-2) 914 to be awarded to the player if any one or more of the player's resulting hands match any of the predetermined resulting hands in column 912.

The embodiment of FIG. 9 also allows player selection of a starting hand, so the player has been dealt two possible starting hands 920, 922 (although any number may have been presented). Starting hand 920 does not meet the starting hand criteria 902, and therefore has no associated pay 904 or multiplier 906. Starting hand 922 includes a suited King/Queen (K,Q Spades), which matches one of the starting hand criteria 902 as shown at row 924. This particular starting hand has a "pay" 904 value of "1," meaning that "1" unit is awarded to the player regardless of any further results. Further, a multiplier of "3" is awarded for this starting hand 922. In the illustrated embodiment, the player selects starting hand 922.

The present invention supports the use of multiple boards to allow multi-hand play by the player. The embodiment of FIG. 9 includes three boards 930, 932, 934, each of which includes five cards. Using the best five cards from the set of cards including the player's selected starting hand 922 and each respective board 930, 932, 934, three five-card resulting hands 940, 942, 944 are formed.

Table 950 summarizes the payouts for each of these resulting hands 940, 942, 944. Because the player's selected starting hand 922 met one of the starting hand criteria 902, the PAY-1 904 may apply for all three played hands. However, in one embodiment of the invention, the PAY-1 904 is only awarded to the player if the player does not receive a payout on a particular resulting hand to which an awarded multiplier can be applied to. In the illustrated embodiment of FIG. 9, it is assumed that the PAY-1 904 amount is paid only if a higher result is not obtained by way of the resulting hand. The multiplier value (MULT) of "3" is shown in table 950 for each of the resulting hands. This is because the selected starting hand 922 met the starting hand criteria 902 as shown in row 924, and therefore applies to each of the resulting hands.

Resulting hand 940 is derived from the cards including the selected starting hand 922 and the board 930. The highest poker rank that can be obtained from these cards is a pair of Twos, as shown in resulting hand 940. Resulting hands 942 and 944 are derived in an analogous fashion. Resulting hand 942 has produced Three of a Kind (three Queens), and resulting hand 944 has produced a Royal Flush (A,K,Q,J,10 Spades). Therefore, the PAY-2 914 for resulting hand 940 is "0," the PAY-2 914 for resulting hand 942 is "5" as shown on row 946, and the PAY-2 914 for resulting hand 944 is "500" as shown on row 948.

In accordance with the present invention, each of the PAY-2 914 payouts can be adjusted by an awarded bonus value, which is a multiplier in the present example. Because resulting hand 940 did not result in any PAY-2 914 award, then the PAY-1 904 amount of "1" unit is awarded as shown in table 950. Resulting hand 942 resulted in a payout (PAY-2) 914 of "5," so the PAY-1 is disregarded. However, the multiplier of "3" is applied to the PAY-2 of "5," resulting in a total payout for resulting hand 942 of "15" units. For the Royal Flush in resulting hand 944, the payout (PAY-2) of "500" units, which is then multiplied by the multiplier of "3," resulting in a total payout of "1500" units for resulting hand 944. The aggregate total payout for the multi-hand play is therefore 1+15+1500=1516 units.

In one embodiment, the cards in each of the boards 930, 932, 934 are provided from separate decks of cards. In another embodiment, a single deck of cards may supply all of the cards of the multiple boards 930, 932, 934. In still other embodiments, X number of decks may supply the cards for Y number of boards, where X and Y represent any positive number while ensuring that an adequate supply of cards is available for the board cards.

It should be noted that multi-hand games may also be played using multiple starting hands and a single board. For example, the player can be provided with (or select) multiple starting hands, each of which may be used with a common board to provide a number of resulting hands equal to the number of provided/selected starting hands. In other multi-hand embodiments, both multiple starting hands and multiple boards may be used, to provide a number of resulting hands equal to the number of provided/selected starting hands times the number of available boards.

FIG. 10 illustrates an example of how total payouts may be calculated in view of varying bet amounts and varying numbers of concurrent hands played. The paytable 1000 includes a first portion including the starting hand type 1002, a first pay column 1004 referred to as PAY($\mathbf{1}_S$), a second pay column 1006 referred to as PAY($\mathbf{10}_S$), and a multiplier column 1008. The PAY($\mathbf{1}_S$) column 1004 represents the payout awarded due to a matching starting (S) hand, where "1" unit is bet and the resulting hand does not result in a higher payout. The PAY($\mathbf{10}_S$) column 1006 represents the payout awarded due to a matching starting hand, where "10" units are bet and the resulting hand does not result in a higher payout. The paytable 1000 could include other PAY($n_S$) columns for other bet amounts. Such columns 1004, 1006 may be presented for each possible bet amount, or a single column may change in response to the player changing his/her wager amount.

The paytable 1000 further includes a second portion which lists the resulting hand types 1010 that will produce a payout. The particular payout for a particular hand type is shown in the pay columns 1012 and 1014, depending on the bet amount. For example, if the player bets "1" unit, then PAY($\mathbf{1}_R$) of column 1012 is used as the payout amount, and if the player bets "10" units, then PAY($\mathbf{10}_S$) of column 1014 is used as the payout amount. Again, other PAY($n_R$) columns may be provided for other bet amounts, or a single PAY($n_R$) column may dynamically change in response to the player's particular wager amount.

FIG. 10 illustrates three representative examples. In EXAMPLE-1, the bet is "1" unit, and the number of hands bet (HAND BET) is "1," resulting in a total bet amount of "1" unit. If the starting hand includes a Four of Hearts (4H) and a Six of Diamonds (6D), this does not match any of the starting hand types 1002, and therefore the PAY($\mathbf{1}_S$) 1004 and MULT 1008 equal "0." In such case, if the resulting hand is Two Pairs, then the PAY($\mathbf{1}_R$) equals "1," thereby resulting in a total payout of "1" unit.

EXAMPLE-2 of FIG. 10 includes a bet amount of "1" unit, but differs from EXAMPLE-1 in that the number of hands bet (HAND BET) is "3," which results in a total bet of "3." Assuming the starting hand includes two red Aces (i.e., Ace of Hearts and Ace of Diamonds), this matches a starting hand type 1002. Because "1" unit was bet, the PAY($\mathbf{1}_S$) column 1004 determines the payout if no larger result ultimately occurs on the resulting hand. The PAY($\mathbf{1}_S$) amount for this matching starting hand type equals "1" unit. Further, the multiplier in column 1008 for this starting hand equals "6." Because three hands are being concurrently played in EXAMPLE-2, three resulting hands are produced. Assuming the first resulting hand is Two Pairs, the resulting hand payout PAY($\mathbf{1}_R$) from column 1012 is "1" unit. However, because of the awarded multiplier of "6," the total payout for the first resulting hand is equal to "6." Assuming the second resulting hand is a Flush, the resulting hand payout PAY($\mathbf{1}_R$) from column 1012 is "4" units, providing a total result for the second resulting hand of "24" units due to the multiplier of "6." Where the third resulting hand is a single pair of Aces, the resulting hand payout PAY($\mathbf{1}_R$) from column 1012 is "0" units as it is not a qualifying resulting hand type 1010. In this case, no payout is provided due to the resulting hand, but the PAY($\mathbf{1}_S$) amount of "1" unit is awarded to the player.

EXAMPLE-3 of FIG. 10 includes a bet amount of "10" units, and like EXAMPLE-2 involves three concurrently played hands (HAND BET equals "3"), resulting in a total bet of "30" units. Assuming the starting hand includes a suited Ace/King (e.g., A/K Clubs; A/K Spades; A/K Diamonds; A/D Hearts), this matches a starting hand type 1002. Because "10" units were bet, the PAY($\mathbf{10}_S$) column 1006 determines the payout if no larger result ultimately occurs on the resulting hand. However, the PAY($\mathbf{10}_S$) amount for this matching starting hand type equals "0" units. Further, the multiplier in column 1008 for this starting hand equals "3." Because three hands are being concurrently played in EXAMPLE-3, three resulting hands are produced. Assuming the first resulting hand is Two Pairs, the resulting hand payout PAY($\mathbf{10}_R$) from column 1014 is "10" units. However, because of the awarded multiplier of "3," the total payout for the first resulting hand is equal to "30" units. Assuming the second resulting hand is four Aces, the resulting hand payout PAY($\mathbf{10}_R$) from column 1014 is "250" units, providing a total result for the second resulting hand of "750" units due to the multiplier of "3." Where the third resulting hand is a single pair of Aces, the resulting hand payout PAY($\mathbf{10}_R$) is "0" units as it is not a qualifying resulting hand type 1010. In this case, no payout is provided due to the resulting hand, and because the PAY($\mathbf{10}_S$) was also "0" units.

Figure 11A:
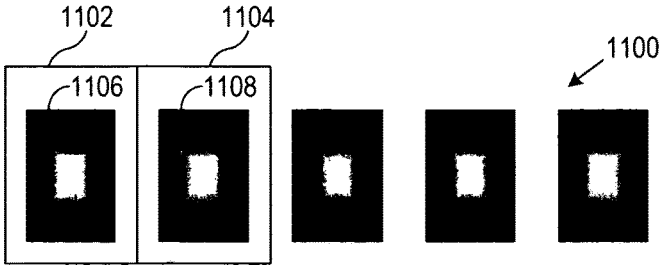
FIGS. 11A, 11B and 11C are diagrams illustrating a progression of an exemplary draw poker hand played in accordance with one embodiment of the present invention.
Figure 11B:
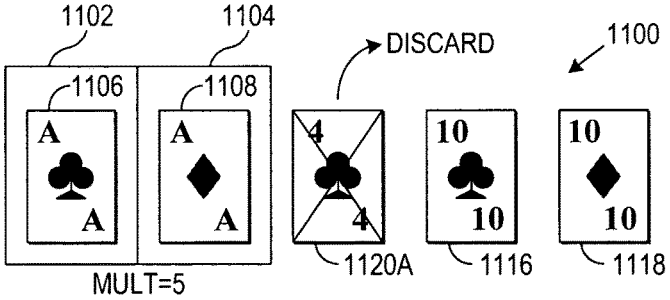
Figure 11C:
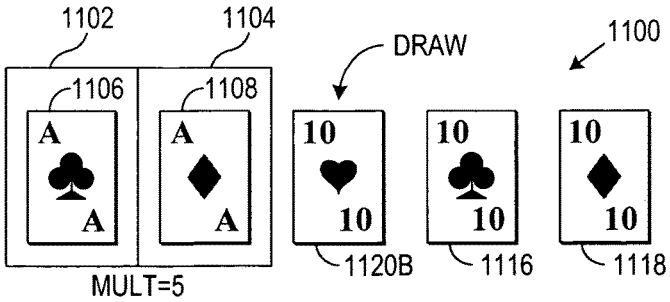

As previously indicated, the present invention is applicable to other poker games. The partial result occurring prior to the resulting hand may be a natural starting hand as in the case of the hole cards in a Hold'em-type poker game, or may be a logical, or predetermined, subset of cards in any poker game. FIGS. 11A, 11B and 11C illustrate this by implementing the principles of the present invention with a draw poker game.

FIGS. 11A, 11B and 11C are diagrams illustrating a progression of a draw poker hand played in accordance with one embodiment of the present invention. While various options may exist such as allowing the player to concurrently participate in multiple draw poker hands, the present example is limited to a single hand. From the description provided herein, those skilled in the art can readily apply these principles to a multi-hand embodiment and/or other poker games involving a draw.

The example of FIGS. 11A, 11B and 11C assume a five-card draw poker game. In accordance with the present invention, a partial hand is used to determine an initial bonus value that may be applied to a resulting hand payout. This "partial hand" may be the cards that are held (i.e., not discarded) by the player. In such an embodiment, various partial hand types may be provided, where some of these partial hand types may include different numbers of cards. For example, one predetermined qualifying partial hand may be a pair, if the player holds two cards and elects to draw three cards. Another example might be four consecutive cards (e.g., 9, 10, J, Q) where the player holds those four cards and elects to draw one card. In a more specific embodiment, such consecutive cards may be of the same suit. For each of these types of predetermined criteria, a bonus value such as a multiplier may be associated therewith. If the player's partial hand, however it may be defined, meets any of the predetermined criteria, the multiplier or other bonus function can be applied to any payout of the resulting hand in the manner previously described.

In accordance with another embodiment and corresponding to the example of FIGS. 11A, 11B and 11C, one or more specific card locations may be designated in advance, or randomly, to delineate the partial hand. Referring to FIG. 11A, a five-card hand 1100 is dealt to the player, and two locations 1102, 1104 are designated as the partial hand cards. Therefore, the cards 1106, 1108 that are dealt to the locations 1102, 1104 represent the starting hand to be compared to the predetermined starting hand criteria. A starting hand paytable 1110 is provided, which identifies predetermined starting hand types and corresponding multiplier values. Resulting hand paytable 1112 identifies predetermined resulting hands and corresponding payout amounts. In another embodiment, the specific card locations used to identify the partial hand may correspond to the card locations of cards in the player's final hand (i.e. after the replacement cards have been issued to the player).

Referring to FIG. 11B, the player has received a pair of Aces (A,A) as cards 1106, 1108 at locations 1102, 1104. The paytable 1110 indicates that the player will therefore be entitled to multiply any payout associated with a resulting hand by "5" as shown at row 1114. In the illustrated example, no starting hand payout is provided (see, e.g., column 212 of FIGS. 2B, 2C, 3A, 3B), although in other embodiments such a starting hand payout may be provided. The player chooses to hold the pair of Aces 1106, 1108 and the pair of Tens 1116, 1118, and opts to discard the Four of Clubs 1120A in an effort to better his/her hand by receiving a replacement/draw card.

FIG. 11C illustrates a final progression stage of the poker hand, where the Four of Clubs 1120 A of FIG. 11B has now been replaced with a new card, which is another Ten 1120B. In the illustrated embodiment, the player has received a Full House (A,A,10,10,10). From the resulting hand paytable 1112, it can be seen at row 1122 that a Full House pays "15" units. In accordance with the present invention, the previous multiplier of "5" awarded to the player as a result of the qualifying starting hand at locations 1102, 1104 is multiplied by the "15" units awarded to the player as a result of the player's resulting hand. Thus, the total payout is "15" units times the multiplier of"5" for a total payout of "75" units.

As indicated above, the partial hand may be any one or more of the cards that are held by the player, and/or cards at statically or dynamically designated card positions. The partial hand may also include other desired cards, such as any one or more of the replacement or "draw" cards received by the player in response to discarding one or more cards of the initial hand.

Figure 12A:
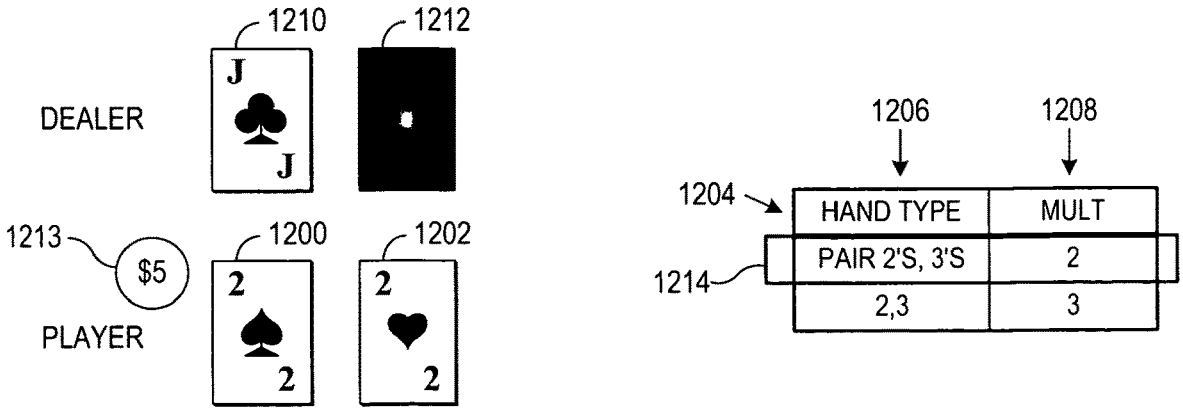
FIGS. 12A, 12B and 12C are diagrams illustrating a progression of an exemplary blackjack poker game which implements principles of the present invention.
Figure 12B:
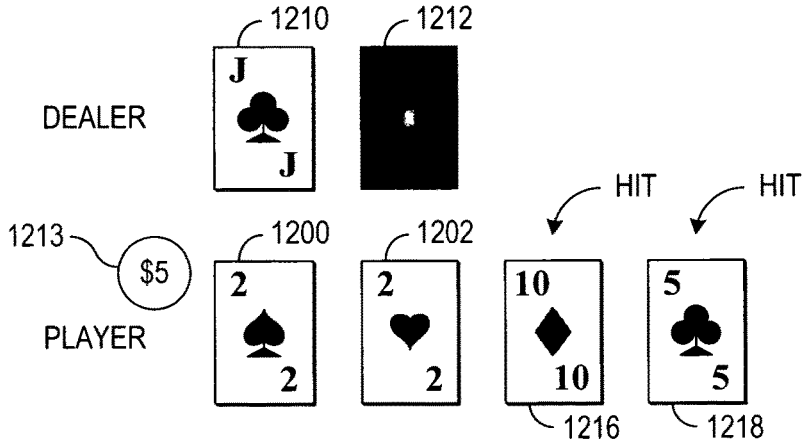
Figure 12C:
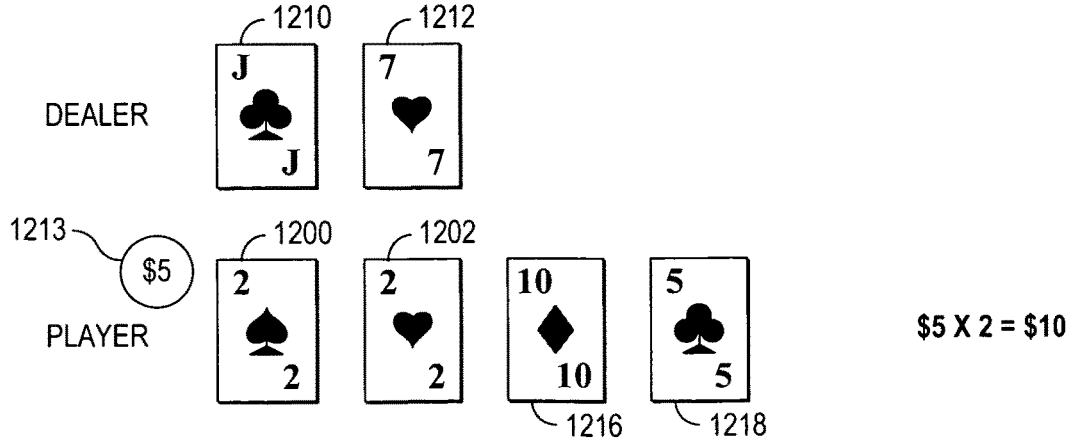

The present invention is applicable to yet other poker games. FIGS. 12A, 12B and 12C illustrate yet another example, where the present invention is implemented in a blackjack poker game. In one embodiment, the starting hand is the two cards 1200, 1202 initially dealt to the player. A paytable 1204 illustrating a starting hand type 1206 and corresponding bonus values 1208 is provided. For example, a pair of Twos or a pair of Threes will provide a multiplier of "2," and a Two/Three combination will provide a multiplier of "3." In blackjack, the resulting hand of the player must beat the dealer's hand, which generally includes one face up card 1210 and one face down card 1212. If the player's resulting hand in fact beats the dealer's hand, the player will win an amount commensurate with the player's bet 1213, which is $5 in the illustrated embodiment. In accordance with the present invention, that resulting amount may be increased by the bonus value (e.g., multiplier) earlier awarded to the player if the player's initial cards 1200, 1202 match any of the starting hand types 1206. In the example of FIG. 12A, the player has been awarded a multiplier of "2," because the player's initial cards 1200, 1202 match a predetermined starting hand type 1206 as shown at row 1214.

The progression of this blackjack hand can be seen in FIG. 12B. The player has opted to "hit," and received a Ten of Diamonds 1216, and to hit again to receive a Five of Clubs 1218. The player stands on a total of "19" (2+2+10+5). As seen in FIG. 12C, the dealer then turns over the face down card 1212 to expose a Seven, resulting in a total of Seventeen (10+7) for the dealer. It is assumed that the dealer must stand on "16," and therefore the player wins the hand. Typically the player would win $5 to cover his/her $5 bet 1213. However, because the player's starting hand 1200, 1202 resulted in a multiplier of "2," the player's $5 award is multiplied by "2," resulting in a total payout of $10.

As evidenced by the various representative embodiments described herein, the present invention may be implemented in a number of different card playing contexts. In situations where a partial/starting hand may naturally occur, and/or where a partial/starting hand may be devised, the present invention may be implemented such that the partial/starting hand is compared to predetermined criteria, and if a match occurs a bonus value contingent upon a final result may be used to adjust that final result. The invention, however, may be utilized in other gaming activity contexts where a subset(s) of the gaming elements/items otherwise associated with the gaming activity can be devised. For example, traditional slot machine games utilize symbol-bearing mechanical and/or electronic reels to present symbol combinations, where symbol combinations matching predetermined symbol combinations present payouts. The present invention can be integrated into such gaming activities as well, as described in connection with the example of FIG. 13.

Figure 13:
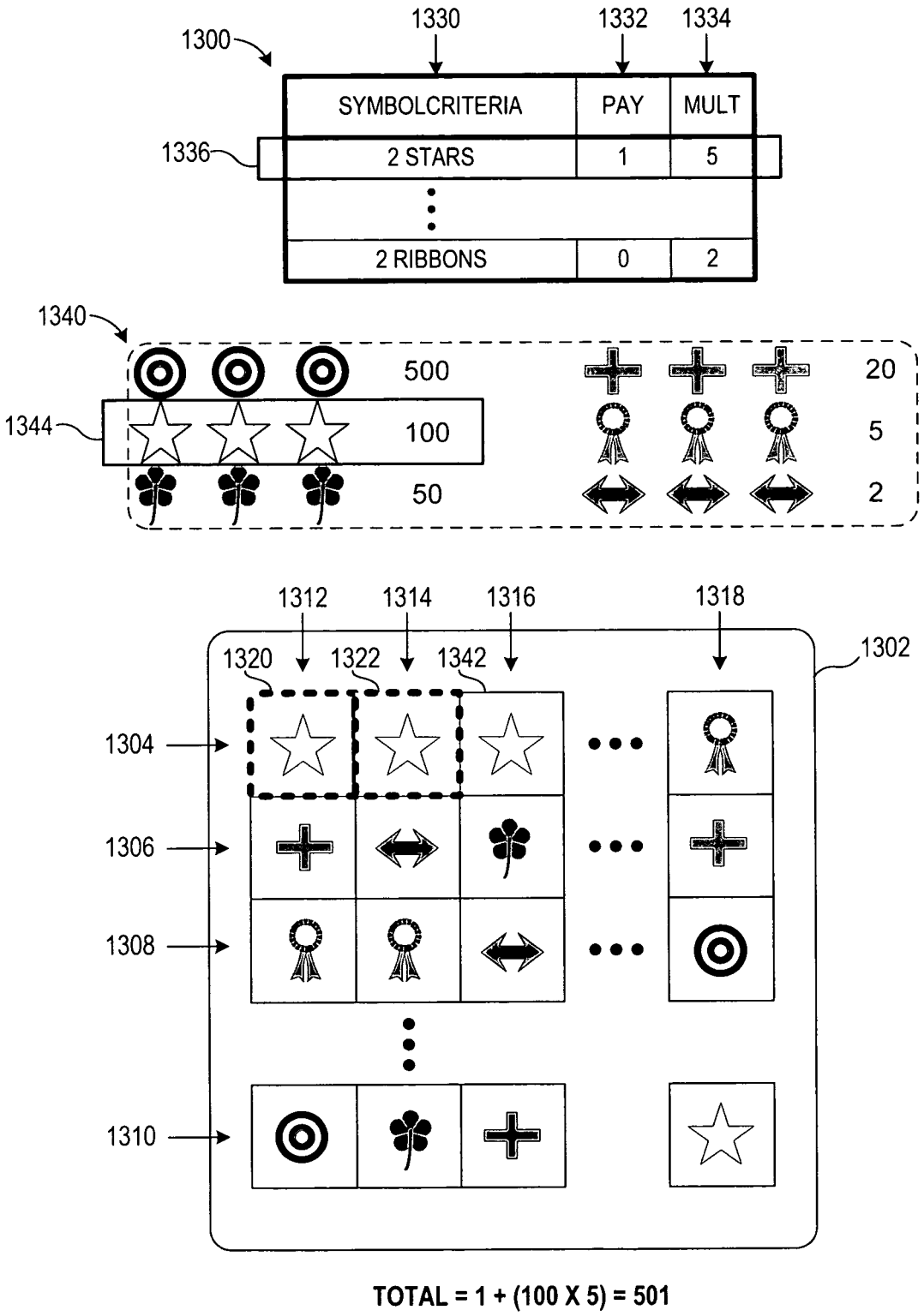
FIG. 13 is a diagram illustrating a representative example in which the present invention may be integrated into a slot game.

FIG. 13 is a diagram illustrating a representative example in which the present invention may be integrated into a slot game where obtaining certain symbol combinations can provide a payout (hereinafter referred to as "slot games"). A first paytable 1300 may be provided to set forth the predetermined partial result criteria to receive the bonus values. The partial result may be devised in any desired fashion, such as the symbols in predetermined locations of the symbol presentation. For example, a mechanical or electronic display 1302 presents various symbol locations, shown at the intersections of rows 1304, 1306, 1308, 1310 and columns 1312, 1314, 1316, 1318. As is known in the art, the number of rows and columns depends on the particular slot game, the number of reels, the number of paylines, and/or other factors. For example, a three "reel" (electronic or mechanical) slot machine may have one payline, thereby presenting one row and three columns for a total of three "display segments" in which symbols may be presented on a single payline. Other embodiments may include many reels, many rows, and many paylines. The partial result may be devised from the symbols occurring at predetermined locations of any one or more of these display segments. For example, the display segments 1320, 1322 may be determined to be the locations at which the symbols presented therein are used to compare against predetermined criteria to determine whether a bonus value may be applied to a final result. Thus, if a symbol combination in display segments 1320, 1322 match the symbol criteria 1330 of the paytable 1300, a bonus value (e.g., multiplier "MULT") 1334 and optionally a non-contingent payout 1332 may be awarded to the player. It should be noted that any number of predetermined symbol locations may be utilized and in any desired pattern, and the two horizontally placed positions 1320, 1322 is only an example. Further, the predetermined symbol locations may remain the same, or may change in a pattern, or randomly, etc.

More particularly, the paytable 1300 may include one or more symbol criteria 1330, such as "2 STARS" in the predetermined locations 1320, 1322, or "2 RIBBONS" in the predetermined locations 1320, 1322, or any other or different desired criteria. The representative paytable 1300 indicates that if "2 STARS" are presented at locations 1320, 1322, a bonus value (a multiplier in this instance) of "5" is awarded. Optionally, an automatic payout of "1" unit may also be provided where "2 STARS" are achieved in the predetermined locations 1320, 1322. A second paytable 1340 is also provided for final results of the slot game, which may be a traditional slot game paytable. For example, if the player receives three stars in a row, the player will be awarded with 100 units/credits.

In the illustrated embodiment, the player has received two STAR symbols in the predetermined locations 1320, 1322. In one embodiment, the symbols at the predetermined locations 1320, 1322 are presented prior to other symbols on the display 1320; i.e., the other positions continue to spin or otherwise do not yet present a symbol in their respective symbol locations. In another embodiment, only the symbols on the vertical reels associated with the reels of the predetermined locations 1320, 1322 are presented, while the remaining reels continue to spin. For example, in a mechanical embodiment, each of the columns 1312, 1314, 1316, 1318 may be implemented using respective vertically-spinning reels, where the reels associated with columns 1312 and 1314 are stopped, while any remaining reels continue to spin. An analogous embodiment would be where the reels spin horizontally and the predetermined locations 1320, 1322 are positioned vertical relative to one another. In another embodiment, all of the symbols may be presented substantially simultaneously, whereby the symbols in the predetermined locations 1320, 1322 are presented substantially contemporaneously with the final result of the slot game. Alternatively, all of the symbols may be presented substantially simultaneously, but the symbols not associated with the predetermined locations 1320, 1322 are temporarily hidden, obscured, or otherwise not clearly presented. Any number of different options may be utilized.

The two STAR symbols in the predetermined locations 1320, 1322 are compared to the symbol criteria 1330 of paytable 1300. Because "2 STARS" in the predetermined locations 1320, 1322 matches one of the predetermined symbol criteria 1330, a PAY 1332 of "1" unit is awarded, and a multiplier (MULT) of"5" is awarded as shown at row 1336. When all symbol locations (i.e., display segments) have presented their respective symbols (including null or blank symbols), this final result is compared to the second paytable 1340 to determine the standard payout. In the illustrated embodiment, the player has received three STARS in a row at locations 1320, 1322, 1342, which corresponds to an award of "100" units as shown at row 1344. Because the player had been awarded a multiplier of "5," the total payout will therefore be "500" units, plus the "1" unit awarded from the PAY 1332, for a total payout of "501" units. In one embodiment, the multiplier is multiplied by the total of all payline winnings. For example, if the player received payouts on four different paylines that totaled "20" units, the multiplier of "5" would result in a total payout of "100" units.

In one variation of this embodiment, the final result producing a payout that is available for increase by the bonus value (multiplier in this example) must include the predetermined locations 1320, 1322. In such an embodiment, three STAR symbols in a row at locations of the display 1302 that do not include at least one or up to all of the predetermined locations 1320, 1322 will not be subject to a payout increase via the multiplier. In another embodiment, any resulting payout will be increased by an awarded multiplier, regardless of whether the winning symbol combinations include symbols from predetermined locations 1320, 1322 or not.

In one embodiment, the predetermined locations (e.g., 1320, 1322 and/or other predetermined display segments) are not part of the standard play grid of rows 1304, 1306, 1308, 1310 and columns 1312, 1314, 1316, 1318. Rather, a separate display of symbols, such as one, two or more separate display segments, may be provided independent of such a standard grid. For example, a separate area including two display segments may be provided which spins before the standard grid. The symbols presented in such separate display segments may then be used as the partial result that determines the multiplier or other bonus value. Other embodiments are also within the scope and spirit of the invention.

Figure 14:
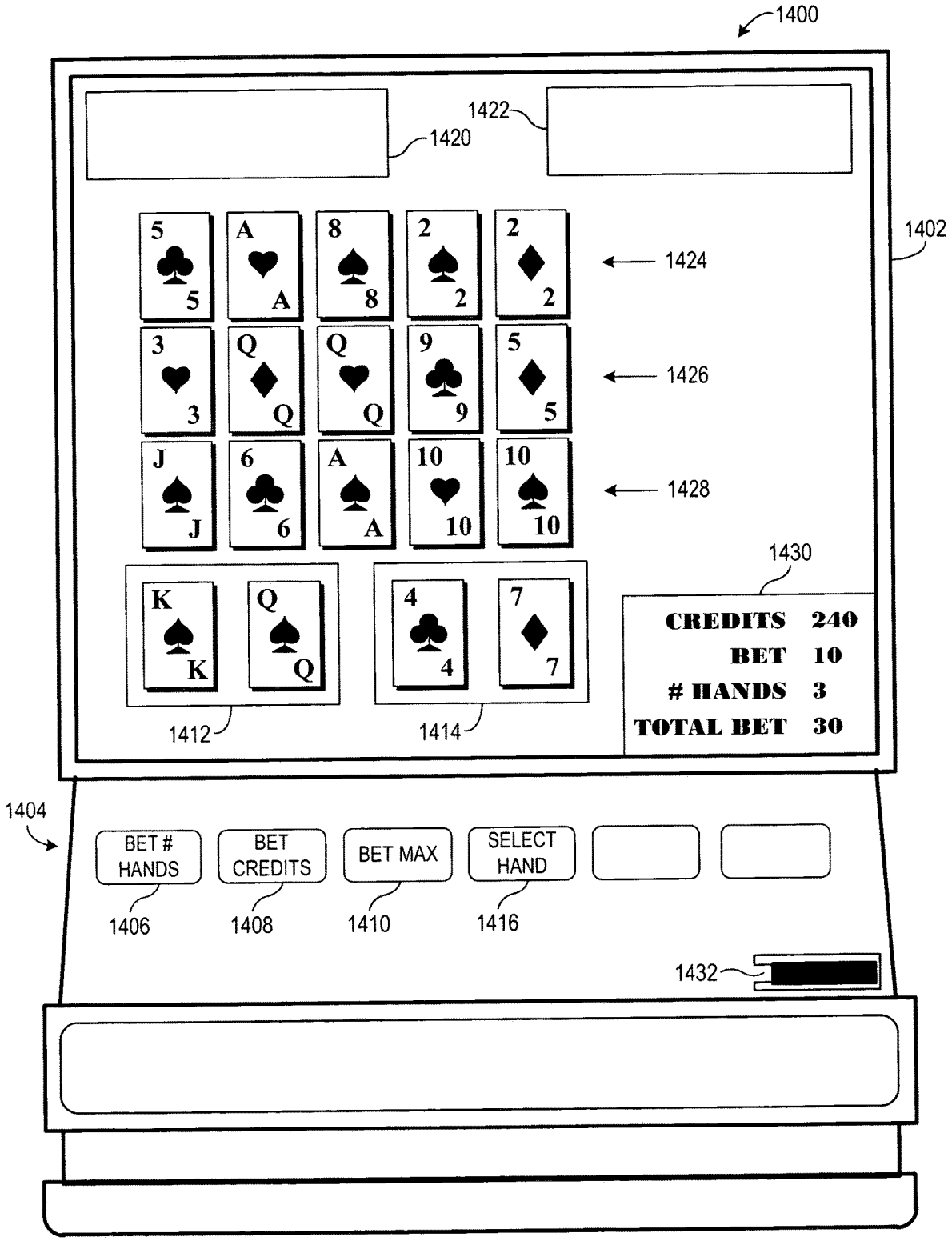
FIG. 14 illustrates a representative embodiment of a casino-style gaming device in which the principles of the present invention may be applied.

The present invention may be implemented in different manners, such as via a live table game or an electronic embodiment. FIG. 14 illustrates a representative embodiment of a casino-style gaming device in which the principles of the present invention may be applied. For purposes of explanation, the description of the gaming device is FIG. 14 is provided in terms of a gaming device in the form of a kiosk or slot machine 1400. However, the present invention is analogously applicable to other computer-based systems.

The illustrated gaming machine 1400 includes a computing system (not shown) to carry out operations according to the invention. The illustrated gaming machine 1400 includes a display 1402, and a user interface 1404, although some or all of the user interface may be provided via the display 1402 in touch screen embodiments. The user interface 1404 allows the user to control and engage in play of the gaming machine 1400. The particular user interface mechanisms associated with user interface 1404 is dependent on the type of gaming machine. For example, the user interface 1404 may include one or more buttons, switches, joysticks, levers, pull-down handles, trackballs, voice-activated input, or any other user input system or mechanism that allows the user to play the particular gaming activity. The user interface 1404 may allow the user to enter coins, bills, or otherwise obtain credits through vouchers, tokens, credit cards, tickets, etc. Various mechanisms for entering such vouchers, tokens, credit cards, coins, tickets, etc. are known in the art. For example, coin/token input mechanisms, card readers, credit card readers, smart card readers, punch card readers, and other mechanisms may be used to enter wagers. It is through the user interface 1404 that the user can initiate and engage in a gaming activity in accordance with the invention. While the illustrated embodiment depicts various buttons for the user interface 1404, it should be recognized that a wide variety of user interface options are available for use in connection with the present invention, including pressing buttons, touching a segment of a touch-screen, entering text, entering voice commands, or other known user entry methodology. The particular user interface mechanism utilized is not relevant to the present invention.

The display device 1402 may include one or more of an electronic display, a mechanical display, and fixed display information such as information such as paytable information associated with a glass/plastic panel on the gaming machine 1400. The cards or other indicia associated with the play of the game may be presented on an electronic display device.

Assuming a multi-hand Hold'em embodiment such as described in connection with FIG. 9, the player uses the user interface 1404 (including the possibility of touch screen or other interface not specifically shown on interface 1404) to bet the appropriate number of hands to play such as via the BET # HANDS button 1406. The player can also select the number of credits to bet via the BET CREDITS button 1408, or may opt to bet the maximum number of credits by selecting the BET MAX button 1410. The player receives a starting hand(s). In the embodiment illustrated in FIG. 14, the player receives multiple starting hands 1412, 1414, and is allowed to select one of the starting hands to play. The user interface (UI) 1404 provides some manner to allow the player to select one of the starting hands 1412, 1414, such as the SELECT HAND button 1416 which may toggle between the available starting hands 1412, 1414. Alternatively, discrete buttons on the UI 1404 may be provided, one for each available starting hand, or any other selection manner may be utilized.

Play continues as previously described. Briefly, the selected starting hand can then be compared to a first paytable 1420 which includes the predetermined starting hand types and corresponding bonus values, such as paytable 900 of FIG. 9. If a match is found, the corresponding bonus value(s) such as a multiplier is awarded to the player for use in potentially increasing a final payout. A second paytable 1422 (which may be integrated with the first paytable 1420) provides the predetermined resulting hand types and corresponding payout values, such as paytable 910 of FIG. 9. As seen in FIG. 14, the player is concurrently playing three hands, as three "boards" 1424, 1426, 1428 are displayed. The player's selected starting hand and the cards of each of the respective boards 1424, 1426, 1428 are used to create three resulting hands. Any resulting hand(s) matching the predetermined resulting hand criteria of paytable 1422 will be awarded a payout, which can be increased using an awarded bonus value (if any) from paytable 1420.

A display segment or panel 1430 may also be provided to display information such as the accumulated credits, current bet amount such as "10" credits (where credits may represent, for example, coins, tokens, dollars, etc.), the number of concurrent hands played, total bet, the number of credits paid out on a particular play, etc. A wager acceptor 1432 is operative to receive wager tokens, coins, bills, credit/debit cards, coupons, smart cards, prepaid casino cards, electronic fund transfer (EFT), tickets, and the like.

Figure 15:
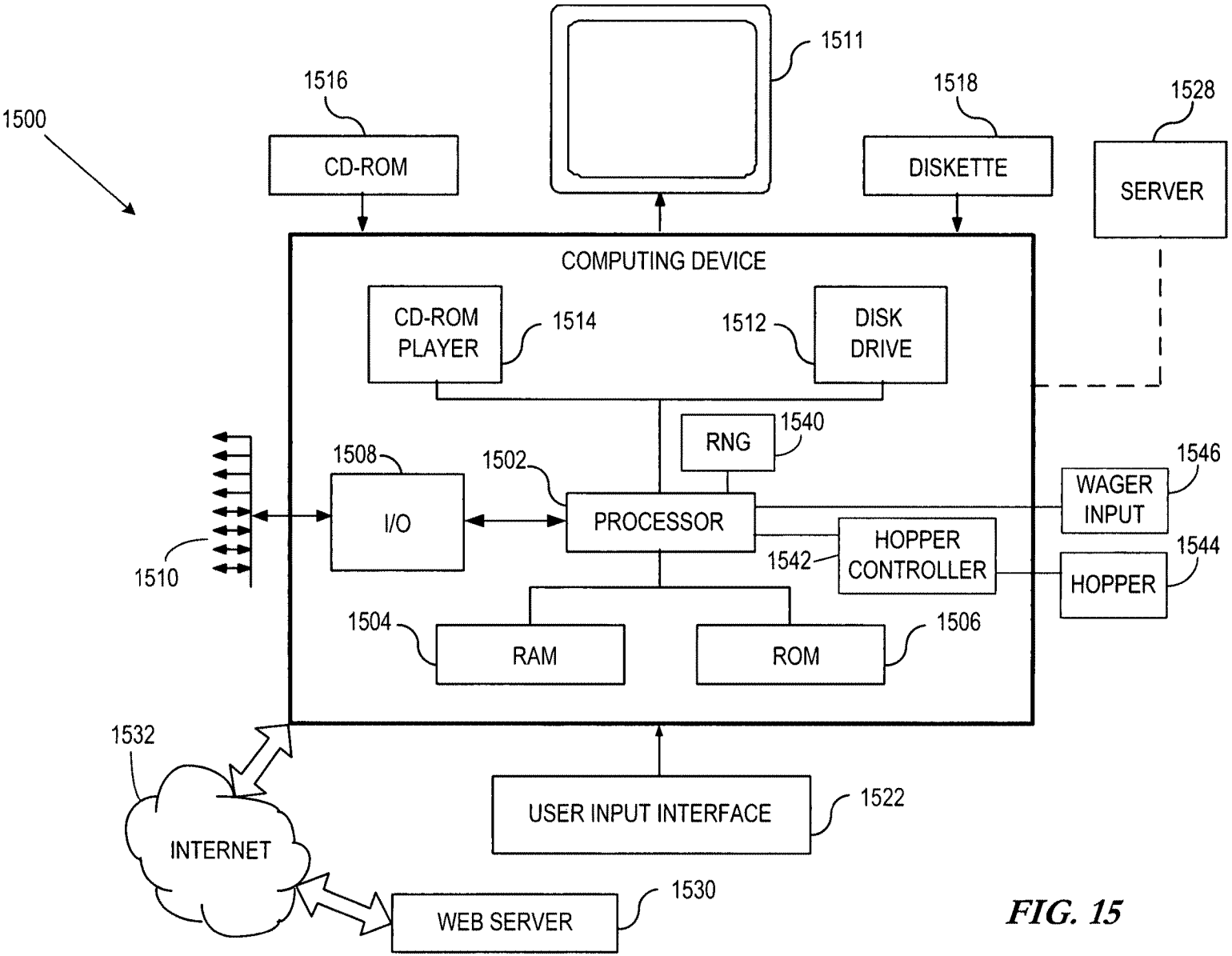
FIG. 15 illustrates a representative example of a computing system capable of carrying out operations in accordance with the invention.

As may now be readily understood, the device 1400 may be programmed to play various embodiments of the invention. The present invention may be implemented as a casino gaming machine such as a slot machine or other special purpose gaming kiosk as described in FIG. 14, or may be implemented via computing systems operating under the direction of local gaming software, and/or remotely-provided software such as provided by an application service provider (ASP). The casino gaming machines utilize computing systems to control and manage the gaming activity. An example of a representative computing system capable of carrying out operations in accordance with the invention is illustrated in FIG. 15.

Hardware, firmware, software or a combination thereof may be used to perform the various gaming functions, display presentations and operations described herein. The functional modules used in connection with the invention may reside in a gaming machine as described, or may alternatively reside on a stand-alone or networked computer. The computing structure 1500 of FIG. 15 is an example computing structure that can be used in connection with such electronic gaming machines, computers, or other computer-implemented devices to carry out operations of the present invention.

The example computing arrangement 1500 suitable for performing the gaming functions in accordance with the present invention typically includes a central processor (CPU) 1502 coupled to random access memory (RAM) 1504 and some variation of read-only memory (ROM) 1506. The ROM 1506 may also represent other types of storage media to store programs, such as programmable ROM (PROM), erasable PROM (EPROM), etc. The processor 1502 may communicate with other internal and external components through input/output (I/O) circuitry 1508 and bussing 1510, to provide control signals, communication signals, and the like.

Chance-based gaming systems such as slot machines, in which the present invention is applicable, are governed by random numbers and processors. A display device 1511 is used to display the gaming activity as facilitated by a random number generator (RNG). RNGs are well-known in the art, and may be implemented using hardware, software operable in connection with the processor 1502, or some combination of hardware and software. The present invention is operable using any known RNG, and may be integrally programmed as part of the processor 1502 operation, or alternatively may be a separate RNG controller 1540.

The computing arrangement 1500 may also include one or more data storage devices, including hard and floppy disk drives 1512, CD-ROM drives 1514, and other hardware capable of reading and/or storing information such as DVD, etc. In one embodiment, software for carrying out the operations in accordance with the present invention may be stored and distributed on a CD-ROM 1516, diskette 1518 or other form of media capable of portably storing information. These storage media may be inserted into, and read by, devices such as the CD-ROM drive 1514, the disk drive 1512, etc. The software may also be transmitted to the computing arrangement 1500 via data signals, such as being downloaded electronically via a network, such as the Internet. Further, as previously described, the software for carrying out the functions associated with the present invention may alternatively be stored in internal memory/storage of the computing device 1500, such as in the ROM 1506.

The computing arrangement 1500 is coupled to the display 1511, which represents a display on which the gaming activities in accordance with the invention are presented. The display 1511 may be any type of known display or presentation screen, such as LCD displays, plasma display, cathode ray tubes (CRT), etc. Where the computing device 1500 represents a stand-alone or networked computer, the display 1511 may represent a standard computer terminal or display capable of displaying multiple windows, frames, etc. Where the computing device is embedded within an electronic gaming machine (see FIG. 14), the display 1511 corresponds to the display screen of the gaming machine/kiosk. A user input interface 1522 such as a mouse, keyboard/keypad, microphone, touch pad, trackball, joystick, touch screen, voice-recognition system, etc. may be provided.

The computing arrangement 1500 may be connected to other computing devices or gaming machines, such as via a network. The computing arrangement 1500 may be connected to a network server 1528 in an intranet or local network configuration. The computer may further be part of a larger network configuration as in a global area network (GAN) such as the Internet. In such a case, the computer accesses one or more web servers 1530 via the Internet 1532.

Other components directed to gaming machine implementations include manners of gaming participant payment, and gaming machine payout. For example, a gaming machine including the computing arrangement 1500 may also include a hopper controller 1542 to determine the amount of payout to be provided to the participant. The hopper controller may be integrally implemented with the processor 1502, or alternatively as a separate hopper controller 1542. A hopper 1544 may also be provided in gaming machine embodiments, where the hopper serves as the mechanism holding the coins/tokens of the machine. The wager input module 1546 represents any mechanism for accepting coins, tokens, coupons, bills, electronic fund transfer (EFT), tickets, credit cards, smart cards, membership cards, etc., for which a participant inputs a wager amount.

Figure 16:
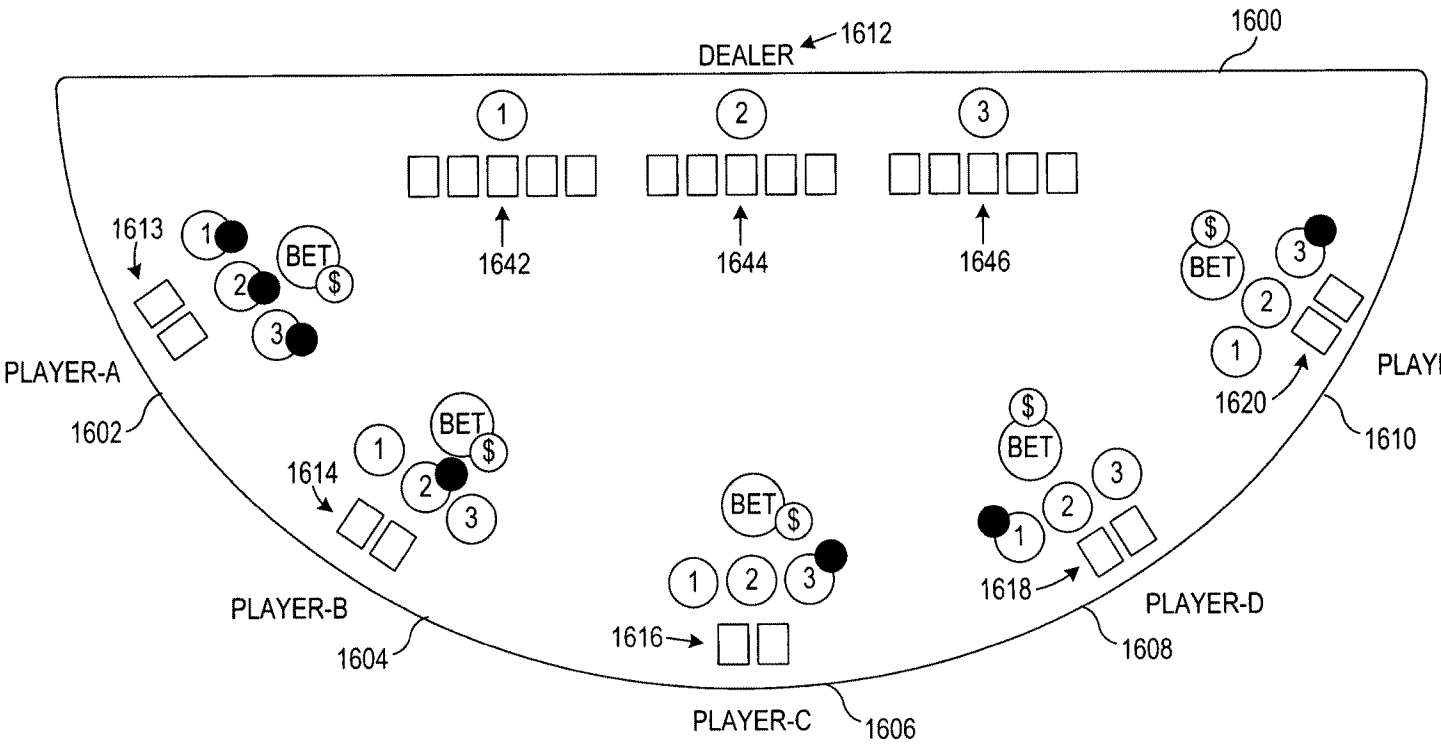
FIG. 16 illustrates an exemplary table layout for participating in a poker game implementing one embodiment of the present invention.

In addition to electronic embodiments, embodiments of the present invention may be played in a live table version. An example table layout 1600 is illustrated in FIG. 16 for use as a gaming table cover or top surface in playing live casino versions of poker games employing the invention. For purposes of illustration and not of limitation, FIG. 16 is described in the context of a Hold'em poker game in accordance with the present invention.

The embodiment of FIG. 16 includes a plurality of player locations 1602, 1604, 1606, 1608, 1610 spaced around a periphery at which one or more players will situate themselves during play of the game. A dealer 1612 may deal one or more starting hands 1613, 1614, 1616, 1618, 1620 to each of the players. Using the starting hand paytable 1625, it can be determined whether each player receives a multiplier, or optionally other bonus amounts such as fixed pay amounts. Each player places a bet, and in multi-hand embodiments, may designate which of a plurality of community hands are to be played. For example, Player-A 1602 has placed an identifier on each of the hand designators 1, 2, 3, which indicates that three hands will be concurrently played using each of the community card boards 1642, 1644, 1646. Player-B 1604, on the other hand, has identified only community card board 1644 by identifying the board 1644 labeled "2."

When each player has arrived at his/her resulting hand(s), the paytable 1630 is used to determine a payout, and if the player was previously awarded a multiplier, then that multiplier is applied to any winning payouts based on the resulting hand. Different payouts may be provided for different wagered amounts. In other embodiments, the players may be playing against each others' hands rather than using the paytable 1630. In such an embodiment, the house is funded in some predetermined manner, so that the house can pay increased winnings due to the multipliers. In other embodiments such as the embodiment illustrated in FIG. 16, play is against the house, and wagering transactions occur only between each player and the house. Other variations are also within the scope and spirit of the invention.

As seen from the foregoing representative embodiments, the present invention provides a manner of introducing bonus or otherwise additional payout awards into gaming activities. In various forms, the invention utilizes a subset(s) of the gaming elements/items otherwise associated with the gaming activity to determine whether a conditional payout increase, contingent upon a final result of the gaming activity, will be awarded. A number of these various gaming activity methodologies in accordance with the present invention are summarized below.

Figure 17:
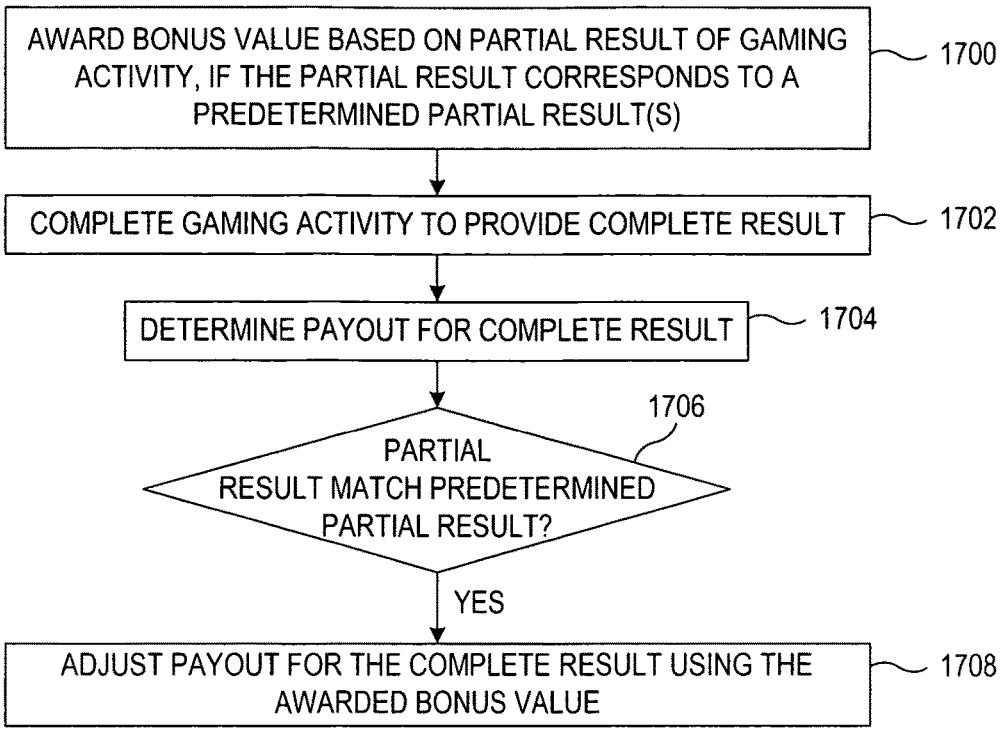
FIG. 17 is a flow diagram directed to a general embodiment of the present invention which introduces additional/bonus payout awards into gaming activities.

FIG. 17 is a flow diagram directed to a general embodiment of the present invention. In the illustrated embodiment, a bonus value is awarded 1700 based on a partial result of a gaming activity, if the partial result corresponds to a predetermined partial result(s). The bonus value may be a multiplier as described above, or may be another value impacting a final result payout award. For example, different mathematical functions may similarly be used, and/or combinations of mathematical functions. As a more particular example, the bonus value could be an exponent to the final payout result. If the bonus value was a "3," and the final payout was "4" units, then $4^3=64$ units. The bonus value may be contingently applied to any final payout value.

The gaming activity is completed 1702 to provide a complete result. In a poker embodiment, this typically involves completing the hand to the point that the player has received all of the cards from which to create the resulting hand. A payout is determined 1704 for the complete result. If the partial result matched any of the predetermined results as determined at decision block 1706, then the payout for the complete result is adjusted 1708 accordingly, using the awarded bonus value.

Figure 18:
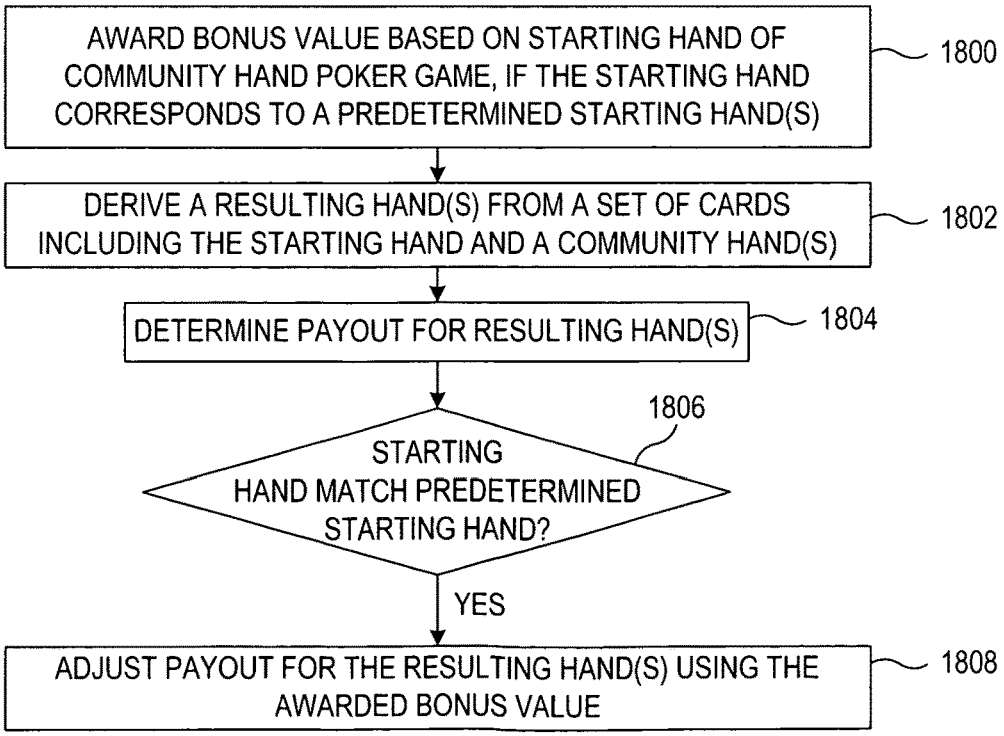
FIG. 18 is a flow diagram illustrating a community hand poker method implementing the principles of the present invention.

One particularly interesting embodiment of the invention is in the context of Hold'em poker games, as previously described. FIG. 18 is a flow diagram illustrating a community hand poker method (e.g., Hold'em poker or other community card game) implementing the principles of the present invention. In the illustrated embodiment, a bonus value such as a multiplier, exponent, or other function is awarded 1800 based on the player's starting hand, if the starting hand corresponds to any of a set of one or more predetermined starting hands. One or more resulting hands are derived 1802 from a set of cards including the starting hand and a community hand(s). A payout for the resulting hand(s) is determined 1804, and if the starting hand matched any of the predetermined starting hands as determined at decision block 1806, the payout is adjusted 1808 for the resulting hand(s) using the awarded bonus value.

Figure 19:
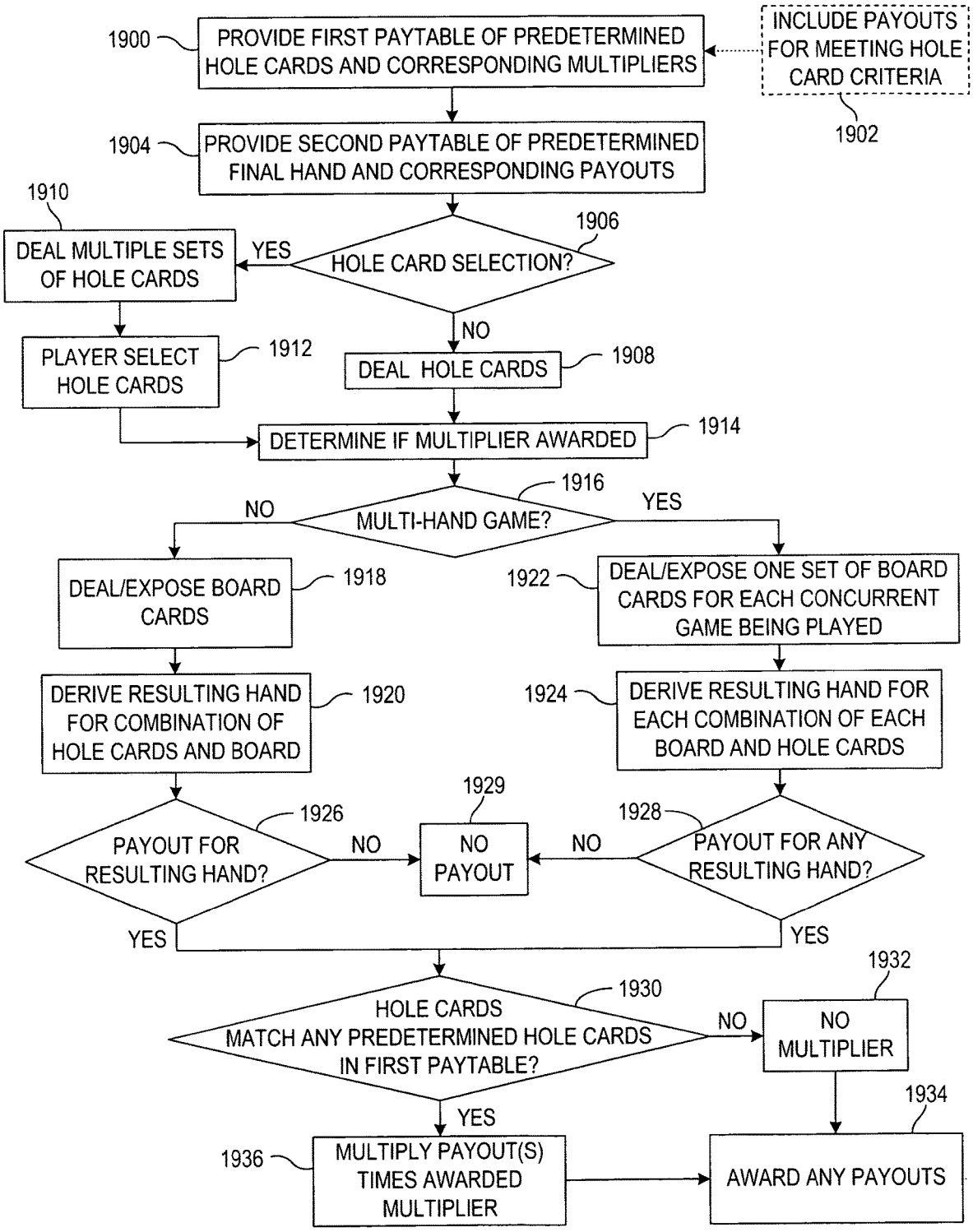
FIG. 19 is a flow diagram illustrating one particular embodiment of a Hold'em embodiment implementing one embodiment of the invention.

FIG. 19 is a flow diagram illustrating one particular embodiment of a Hold'em embodiment of the invention. A first paytable of predetermined hole cards and corresponding multipliers is provided 1900. If payouts are also desired for particular starting hand combinations, they may be included 1902 in the first paytable. A second paytable of predetermined final hands and corresponding payouts is also provided 1904. If the game does includes the option for the player to select from a plurality of starting hands as determined at decision block 1906, then the hole cards are dealt 1908 without such selection. Otherwise, multiple sets of hole cards are dealt 1910, and the player selects 1912 a set of hole cards from the plurality of sets of selectable hole cards.

Based on the player's hole cards, it is determined 1914 whether a multiplier is awarded to the player. This may be determined by comparing the player's hole cards to the set of predetermined hole cards in the first paytable, and if a match is found, identifying the corresponding multiplier for that particular hole card combination.

The game may be a single-hand game or a multiple-hand game. If the game is not a multi-hand game as determined at decision block 1916, the board cards are dealt or otherwise exposed as shown at block 1918, and a resulting hand is derived 1920 from a combination of the hole cards and the cards of the board. If it is a multi-hand game, one set of board cards is dealt/exposed 1922 for each concurrent game being played. For example, if three games are concurrently played, then three boards are dealt or otherwise exposed. A resulting hand is derived 1924 for each combination of the hole cards and the plurality of boards. If no payout results from any of the resulting hands as determined at decision blocks 1926, 1928 then no payout 1929 is provided and any awarded multiplier has no effect. An exception is the case where payouts are awarded based on the player's hole cards, in which case the player may receive some known payout based on the hole cards that match the predetermined hole cards in the first paytable.

If a payout results in either the single-hand or multi-hand embodiments, the multiplier will be applied to the resulting payouts if a multiplier was awarded at block 1914. More particularly, if the hole cards did not match any of the predetermined hold cards in the first paytable as illustrated at decision block 1930, then no multiplier is applied as shown at block 1932, and any payout from the resulting hand is awarded 1934. If any of the hole cards matched any of the predetermined hold cards in the first paytable as illustrated at decision block 1930, then the resulting payout, or potentially multiple payouts in a multi-hand embodiment, are increased using the multiplier as shown at block 1936. The increased payout can then be awarded 1934 to the player.

Figure 20:
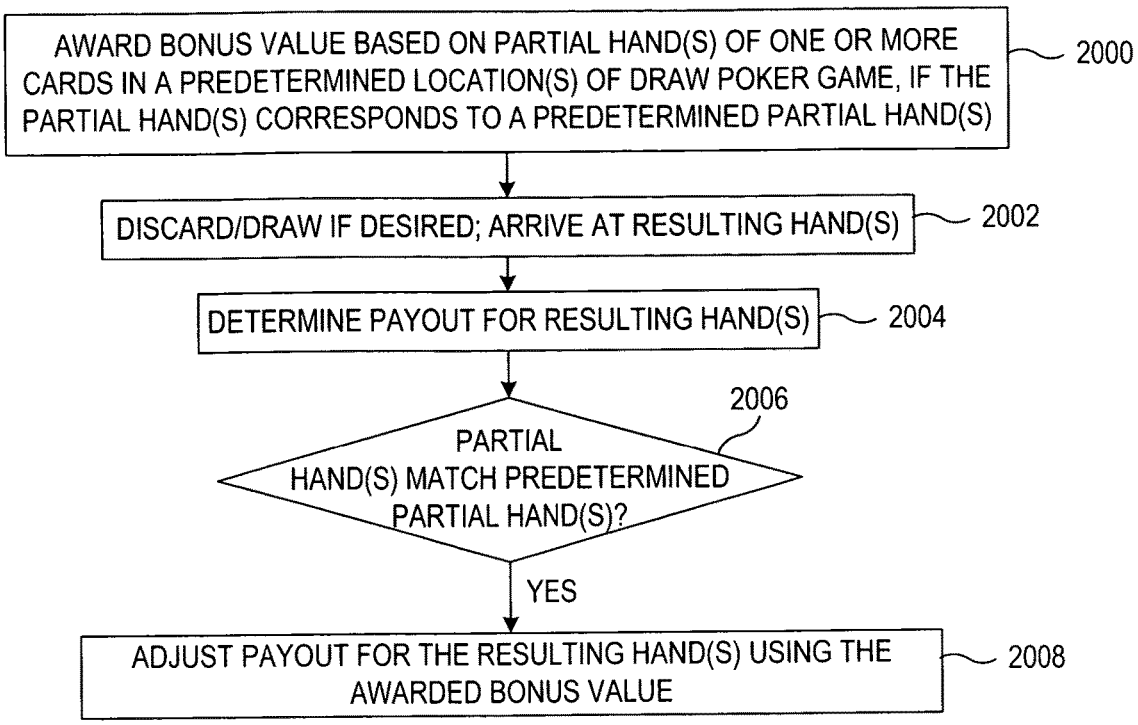
FIG. 20 is a flow diagram illustrating a representative embodiment of the invention in connection with a draw poker methodology.

As previously indicated, the invention may be integrated with a variety of different known gaming activities where a subset(s) of the gaming elements is already available or can be devised. FIG. 20 is a flow diagram illustrating a draw poker game incorporating the present invention as was previously described in connection with FIGS. 11A, 11B, 11C. A bonus value such as a multiplier is awarded 2000 based on a partial hand(s) of one or more cards in a predetermined location(s) of a draw poker game, if the partial hand corresponds to any predetermined partial hands.

As shown at block 2002, the player may discard and draw cards if desired to arrive at a resulting hand, or multiple resulting hands if multiple hands are being played. The payout is determined 2004 for any resulting hands, and if the partial hand matched any of the predetermined partial hands as determined at decision block 2006, the payout is adjusted 2008 using the awarded bonus value.

Figure 21:
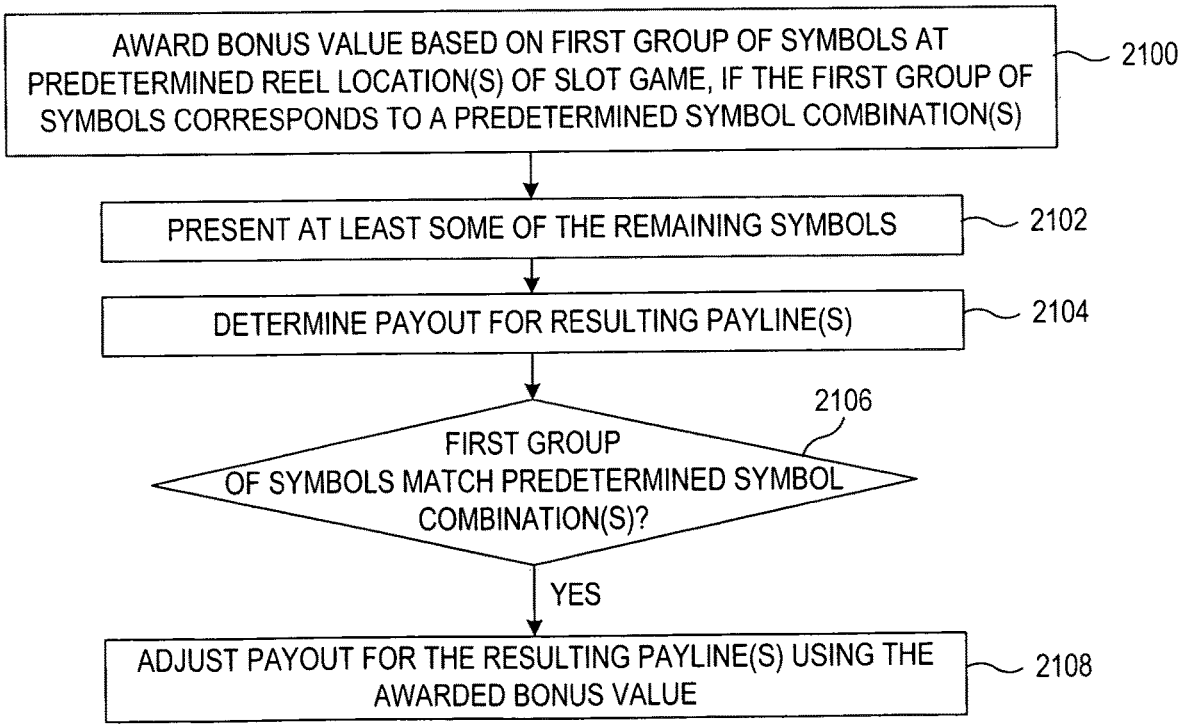
FIG. 21 is a flow diagram illustrating one particular embodiment of the invention in a slot game context.

FIG. 21 is a flow diagram illustrating yet another embodiment in a slot game context, such as the embodiment described in connection with FIG. 13. A bonus value may be awarded 2100 based on a first group of one or more symbols being presented at particular locations of the slot game, if the first group of symbols corresponds to a predetermined symbol combination. The particular locations may be determined in advance, or may change but with highlighting or other delineations to identify which locations are relevant for comparison to the predetermined symbol combinations. Some or all of the remaining reel locations are then presented 2102, and a payout is determined 2104 for active paylines. If the first group of symbols matches any of the predetermined symbol combinations as determined at decision block 2106, then any payout received as a result of the resulting active paylines is adjusted 2108 using the bonus value.

The foregoing description of the exemplary embodiment of the invention has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of the gaming activities. It is intended that the scope of the invention be limited not with this detailed description, but rather determined from the claims appended hereto.

What is claimed is:

1. A video poker gaming machine comprising:

a casino-styled gaming machine body;

a video display device mounted in the game machine body, the video display device configured to display a plurality of card positions;

a player interface attached to the gaming machine body, the player interface including a plurality of mechanical buttons;

a wager input device attached to the gaming machine body, the wager input device structured to receive physical items associated with currency values;

a random number generator housed in the gaming machine body, the random number generator configured to generate random values;

a memory housed in the gaming machine body, the memory configured to store a credit amount and a plurality of virtual playing cards; and a processor housed in the game machine body and connected to the video display device, player interface, wager input device, random number generator and memory, the processor operable to:

receive a signal from the wager input device indicating that a physical item associated with a currency value has been received;

increase the credit amount stored in the memory based on the currency value of the received physical item;

receive a signal from the player interface to initiate a gaming activity in response to placement of a wager, the wager decreasing the credit amount stored in the memory;

receive one or more signals from the random number generator to randomly designate one or more card positions in the plurality of card positions displayed on the video display, wherein the one or more card positions are randomly designated prior to presenting any virtual playing cards face-up in the card positions on the video display;

present an initial draw poker hand on the video display by utilizing random signals from the random number generator to select and deal a portion of the virtual playing cards stored in the memory face-up to respective card positions of the plurality of card positions;

identify a partial hand as one or more of the virtual playing cards of the initial draw poker hand that are respectively presented on the video display in the designated one or more card positions;

award a bonus value when the partial hand meets a predefined condition, wherein the bonus value is awarded prior to completion of a final draw poker hand, the awarded bonus value displayed on the video display;

complete the final draw poker hand by replacing zero or more cards discarded from the initial draw poker hand in response to signals received from one or more of the mechanical buttons on the player interface, wherein the final draw poker hand is presented on the video display;

determine whether a poker hand payout is awarded based on the final draw poker hand;

modify the poker hand payout when the partial hand satisfied the predefined condition;

display the modified poker hand payout on the video display; and increase the credit amount stored in the memory based on the modified poker hand payout.

* * * * *